US008657644B2

(12) United States Patent
Tada et al.

(10) Patent No.: US 8,657,644 B2
(45) Date of Patent: Feb. 25, 2014

(54) EDDY CURRENT SENSOR AND POLISHING METHOD AND APPARATUS

(75) Inventors: Mitsuo Tada, Tokyo (JP); Taro Takahashi, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 13/313,407

(22) Filed: Dec. 7, 2011

(65) Prior Publication Data

US 2012/0088438 A1 Apr. 12, 2012

Related U.S. Application Data

(63) Continuation-in-part of application No. 13/005,684, filed on Jan. 13, 2011, now abandoned, which is a continuation-in-part of application No. 12/511,344, filed on Jul. 29, 2009, now Pat. No. 8,454,407.

(30) Foreign Application Priority Data

| | | |
|---|---|---|
| Jul. 16, 2009 | (JP) | 2009-167788 |
| Dec. 10, 2010 | (JP) | 2010-275310 |
| Nov. 25, 2011 | (JP) | 2011-257130 |

(51) Int. Cl.
*B24B 49/10* (2006.01)

(52) U.S. Cl.
USPC ..... 451/5; 451/288

(58) Field of Classification Search
USPC ..... 451/41, 37, 63, 5, 6, 8, 9, 287, 288
See application file for complete search history.

(56) References Cited

U.S. PATENT DOCUMENTS

| | | | | |
|---|---|---|---|---|
| 6,609,950 | B2 * | 8/2003 | Kimura et al. | 451/5 |
| 6,929,531 | B2 | 8/2005 | Gotkis et al. | |
| 7,258,595 | B2 | 8/2007 | Tada et al. | |
| 7,795,865 | B2 * | 9/2010 | Fujita et al. | 324/229 |
| 2008/0139087 | A1 * | 6/2008 | Togawa et al. | 451/8 |

FOREIGN PATENT DOCUMENTS

| | | |
|---|---|---|
| JP | 8-145956 | 6/1996 |
| JP | 2001-345292 | 12/2001 |
| JP | 2004-009259 | 1/2004 |
| JP | 2004-195629 | 7/2004 |
| JP | 2005-121616 | 5/2005 |
| JP | 2006-255851 | 9/2006 |
| JP | 2007-311503 | 11/2007 |
| WO | 2008/044786 | 4/2008 |

* cited by examiner

*Primary Examiner* — Robert Rose
(74) *Attorney, Agent, or Firm* — Wenderoth, Lind & Ponack, L.L.P.

(57) ABSTRACT

An eddy current sensor is used for detecting a metal film (or conductive film) formed on a surface of a substrate such as a semiconductor wafer. The eddy current sensor includes a sensor coil disposed near a metal film or a conductive film formed on a substrate, and the sensor coil includes a detection coil operable to detect an eddy current produced in the metal film or the conductive film. The detection coil includes a coil formed by winding a wire by a single row and plural layers, the row being defined as a direction perpendicular to the substrate and the layer being defined as a direction parallel to the substrate.

32 Claims, 26 Drawing Sheets

EDDY CURRENT SENSOR AND POLISHING METHOD AND APPARATUS

CLAIM PRIORITY

This is a continuation-in-part application of U.S. application Ser. No. 13/005,684 filed Jan. 13, 2011, now abandoned, the disclosure of which is hereby incorporated by reference, which is a continuation-in-part application of U.S. application Ser. No. 12/511,344 filed Jul. 29, 2009, now U.S. Pat. No. 8,454,407, the disclosure of which is hereby incorporated by reference. The present application claims benefit of priority from Japanese patent application number 2009-167788 filed Jul. 16, 2009, Japanese patent application number 2010-275310 filed Dec. 10, 2010 and Japanese patent application number 2011-257130 filed Nov. 25, 2011.

BACKGROUND OF THE INVENTION

1. Field of the Invention

The present invention relates to an eddy current sensor suitable for detecting a metal film (or conductive film) formed on a surface of a substrate such as a semiconductor wafer. Further, the present invention relates to a polishing method and apparatus for polishing the substrate while monitoring the metal film (or conductive film) formed on the substrate by the eddy current sensor to remove the metal film (or conductive film).

2. Description of the Related Art

In recent years, high integration and high density in semiconductor device demands smaller and smaller wiring patterns or interconnections and also more and more interconnection layers. Multilayer interconnections in smaller circuits result in greater steps which reflect surface irregularities on lower interconnection layers. An increase in the number of interconnection layers makes film coating performance (step coverage) poor over stepped configurations of thin films. Therefore, better multilayer interconnections need to have the improved step coverage and proper surface planarization. Further, since the depth of focus of a photolithographic optical system is smaller with miniaturization of a photolithographic process, a surface of the semiconductor device needs to be planarized such that irregular steps on the surface of the semiconductor device will fall within the depth of focus.

Thus, in a manufacturing process of a semiconductor device, it increasingly becomes important to planarize a surface of the semiconductor device. One of the most important planarizing technologies is chemical mechanical polishing (CMP). In the chemical mechanical polishing, while a polishing liquid containing abrasive particles such as silica ($SiO_2$) therein is supplied onto a polishing surface such as a polishing pad, a substrate such as a semiconductor wafer is brought into sliding contact with the polishing surface and polished using the polishing apparatus.

In forming the above mentioned multilayer interconnections, there has been performed a process in which grooves for interconnections having a predetermined pattern are formed in an insulating layer (dielectric material) on a substrate, the substrate is then dipped in a plating solution to plate the substrate with copper (Cu), for example, by an electroless plating or an electrolytic plating, and then unnecessary portions of a copper layer is selectively removed from the substrate by a CMP process, while leaving only the copper layer in the grooves for interconnections. In this case, if the substrate is insufficiently polished to leave the copper layer on the insulating layer (oxide film), then the circuits would not be separated from each other, but short-circuited. Conversely, if the copper layer in the interconnection grooves is excessively polished away together with the insulating layer, then the resistance of the circuits on the substrate would be so increased that the entirety of the semiconductor substrate might possibly need to be discarded, resulting in a large loss. This holds true for the cases in which other metal films such as aluminum layer are formed, and then polished by the CMP process.

The polishing apparatus which performs the above-mentioned CMP process includes a polishing table having a polishing surface formed by a polishing pad, and a substrate holding device, which is referred to as a top ring or a polishing head, for holding a semiconductor wafer (substrate). When a semiconductor wafer is polished with such a polishing apparatus, the semiconductor wafer is held and pressed against the polishing surface under a predetermined pressure by the substrate holding device. At this time, the polishing table and the substrate holding device are moved relative to each other to bring the semiconductor wafer into sliding contact with the polishing surface, so that the surface of the semiconductor wafer is polished to a flat mirror finish.

Such polishing apparatuses include a type of polishing apparatus which has a pressure chamber formed by an elastic membrane at the lower portion of the substrate holding device and supplies the pressure chamber with a fluid such as air to press the semiconductor wafer against the polishing substrate under a fluid pressure through the elastic membrane, as disclosed in Japanese laid-open patent publication No. 2006-255851, and a type of polishing apparatus which has a holding surface having rigidity formed by ceramics or the like at the lower portion of the substrate holding device and applies a force to the holding surface by an air cylinder or the like to press the semiconductor wafer against the polishing surface.

SUMMARY OF THE INVENTION

In the above-mentioned conventional polishing apparatuses, after the semiconductor wafer is held by the substrate holding device and brought into contact with the polishing surface of the polishing pad, the semiconductor wafer is pressed against the polishing surface under a fluid pressure through the elastic membrane by supplying a pressurized fluid such as compressed air to the pressure chamber or under a force applied to the holding surface by an air cylinder or the like, thereby polishing the semiconductor wafer and removing a metal film on the semiconductor wafer.

After a polishing process is completed, if a subsequent process is carried out in such a state that the metal film is left on the semiconductor wafer, then problems of short circuit or the like occur, and thus the semiconductor wafer cannot be used. Therefore, after the polishing process is completed, the wafer is separated and moved away from the polishing pad (polishing surface), and then an inspection on the presence of the remaining metal film is carried out. In this manner, although it is possible to confirm the remaining film, it takes time for inspection to reduce wafer processing capability. After the inspection, if the remaining film is detected on the wafer, then it is necessary to carry out repolishing. However, in the case where polishing is carried out after the wafer is moved away from the polishing pad, processing time per wafer increases. That is, the throughput is lowered.

In order to solve the above problem of lowering of the throughput caused by the inspection on the presence of the remaining metal film and the repolishing after the inspection, in U.S. patent application Ser. No. 12/511,344 filed Jul. 29, 2009, there has been proposed a polishing method and apparatus which can shorten inspection time by performing an inspection on whether or not there is a remaining film of a metal film (or conductive film) on a substrate such as a semiconductor wafer during polishing, and can shorten processing time by performing additional polishing of the substrate as it is in the case where the remaining film is detected.

In the proposed U.S. patent application Ser. No. 12/511,344, an eddy current sensor which responds to a metal film such as a Cu film formed on a substrate such as a semiconductor wafer is disposed in a polishing table and the eddy current sensor outputs a certain voltage value in response to the metal film of the substrate while the eddy current sensor passes through under the substrate by rotation of the polishing table during polishing of the substrate, and thus removal of the metal film is detected by monitoring the output of the eddy current sensor. In this case, detection of the thin metal film when polishing progresses is performed by increasing oscillation frequency of the eddy current sensor, increasing amplification degree of an internal circuit of the eddy current sensor, or increasing exciting voltage of the eddy current sensor.

However, in the case where the oscillation frequency of the eddy current sensor is increased, a coil resonance frequency is decreased by capacitance of the coil itself. Further, in the case where the amplification degree of the internal circuit of the eddy current sensor is increased, influence of a circuit noise becomes greater. Further, in the case where the exciting voltage of the eddy current sensor is increased, there is a problem of stability of characteristics.

The present invention has been made in view of the above circumstances. It is therefore an object of the present invention to provide an eddy current sensor which is capable of detecting a thin metal film (or thin conductive film) on a substrate such as a semiconductor wafer without increasing oscillation frequency, amplification degree of an internal circuit and exciting voltage of the eddy current sensor.

Further, it is an object of the present invention to provide a polishing method and apparatus which can shorten inspection time by performing an inspection on whether or not there is a remaining film of a metal film (or conductive film) on a substrate during polishing, and can shorten processing time by performing additional polishing of the substrate as it is in the case where the remaining film is detected.

In order to achieve the above objects, according to a first aspect of the present invention, there is provided an eddy current sensor comprising: a sensor coil disposed near a metal film or a conductive film formed on a substrate; a signal source configured to supply an AC signal to the sensor coil to produce an eddy current in the metal film or the conductive film; and a detection circuit operable to detect the eddy current produced in the metal film or the conductive film on the basis of an output of the sensor coil; wherein the sensor coil comprises an oscillation coil connected to the signal source, a detection coil operable to detect the eddy current produced in the metal film or the conductive film, and a balancing coil connected in series to the detection coil; and the detection coil comprises a coil formed by winding a wire or a conductive material by a single row and plural layers; the row being defined as a direction perpendicular to the substrate and the layer being defined as a direction parallel to the substrate.

According to the eddy current sensor of the present invention, since the detection coil of the eddy current sensor comprises a coil formed by winding a wire or a conductive material in a single row and plural layers, the detection coil can be brought close to the substrate, and capacitance component between lines can be small, thus improving sensor sensitivity. Therefore, the thin metal film (or thin conductive film) on the substrate such as a semiconductor wafer can be detected without increasing oscillation frequency, amplification degree of an internal circuit and exciting voltage of the eddy current sensor. The detection coil may be flat so as to have a thickness corresponding to only a diameter of the wire or a conductive material in a row direction by winding the wire or the conductive material in a spiral fashion by plural layers in parallel with a surface having the metal film (or conductive film) of the semiconductor wafer (substrate). The detection coil may be curved so as to have a predetermined thickness greater than the diameter of the wire or the conductive material in a row direction by winding the wire or the conductive material in a spiral fashion by plural layers so as to be closer to (or away from) the substrate.

In a preferred aspect of the present invention, the oscillation coil comprises a coil formed by winding a wire or a conductive material by a single row and plural layers or a coil formed by winding a wire or a conductive material by plural rows and a single layer or by plural rows and plural layers.

According to the present invention, in the case where the oscillation coil of the eddy current sensor comprises a coil formed by winding a wire or a conductive material in a single row and plural layers, the oscillation frequency of coil resonance frequency can be improved, and hence the thin film can be stably detected even in an increased oscillation frequency.

In a preferred aspect of the present invention, the balancing coil comprises a coil formed by winding a wire or a conductive material by a single row and plural layers.

In a preferred aspect of the present invention, at least one of the detection coil, the oscillation coil and the balancing coil comprises the coils formed by winding a wire or a conductive material by a single row and plural layers and connected in series.

According to the present invention, plural coils formed by winding a wire or a conductive material by a single row and plural layers are arranged in a row direction and a clearance is provided between the adjacent coils so as to prevent the adjacent coils from contacting each other. A material having a low-magnetic permeability is provided in the clearance. Thus, the sensor coil can be brought close to the substrate even if the coils having a single row and plural layers are arranged in plural rows or multiple rows, thus improving sensor sensitivity.

Further, according to the present invention, plural coils having a single row and N-layers are connected in series, and thus synthetic inductance of coils is equal to the sum of the inductance of plural coils and mutual inductance between the adjacent coils. Therefore, synthetic inductance of coils increases, and sensor outputs of the entire coil increases, and thus a metal film can be detected with high accuracy.

In a preferred aspect of the present invention, the oscillation coil is curved so as to be closer to the substrate toward a radially outward edge of the oscillation coil.

According to the present invention, the oscillation coil comprises a coil formed by winding a wire or a conductive material such that the coil is curved in the form of concave sphere so as to be dented toward the balancing coil side at a radially inner side and to be closer to the detection coil side toward a radially outer side. In this manner, since the oscillation coil is curved in the form of concave sphere, an oscillation magnetic field can converge on the central area and the sensor sensitivity can be improved.

In a preferred aspect of the present invention, the detection coil and the oscillation coil may have different coil outer diameters.

According to the present invention, the outer diameter (diameter) of the detection coil is smaller than the outer diameter (diameter) of the oscillation coil (exciting coil), and thus minute detection of metal film as a target can be performed.

In a preferred aspect of the present invention, the detection coil, the oscillation coil and the balancing coil are arranged in this order from the substrate side.

According to the present invention, it is preferable that a zero point of a detection output from the sensor coil can be adjusted automatically by the detection coil and the balancing coil. By adjusting the zero point, only a variation signal corresponding to a thickness of the metal film (or conductive film) to be measured can be amplified and detected.

In a preferred aspect of the present invention, the detection coil, the oscillation coil and the balancing coil are arranged in a concentric fashion.

According to the present invention, by arranging the detection coil, the oscillation coil and the balancing coil in a concentric fashion, the sensor coil in its entirety can be arranged closer to the substrate. Thus, the sensor sensitivity can be improved.

In a preferred aspect of the present invention, the sensor coil is housed in a tubular member made of a material having a high-magnetic permeability.

According to the present invention, a magnetic flux from the sensor coil forms a path (magnetic circuit) so as to pass through the tubular member having a high-magnetic permeability, which is located around the sensor coil and then pass through the metal film (or conductive film) to be measured. Since the magnetic flux does not pass through a member in an installation environment, the magnetic flux is not attenuated. Thus, an eddy current can effectively be produced in the metal film (or conductive film) by the sensor coil, and the metal film (or conductive film) can be measured with high sensitivity.

According to a second aspect of the present invention, there is provided a polishing method of polishing a film on a substrate as an object to be polished by pressing the substrate against a polishing surface on a rotating polishing table, the polishing method comprising: scanning a surface, being polished, of the substrate by an end point detecting sensor provided in the polishing table while the polishing table is rotated, during polishing of the substrate; monitoring an output of the end point detecting sensor obtained by scanning the surface, being polished, of the substrate; detecting a polishing end point from a change in the output of the end point detecting sensor; and monitoring an output of the end point detecting sensor or a different sensor after detecting the polishing end point and performing monitoring of the remaining film for detecting a film left on a part of the substrate.

According to the polishing method of the present invention, while the end point detecting sensor passes through under the substrate by rotation of the polishing table, the end point detecting sensor outputs a certain voltage value or the like in response to a metal film (or conductive film) of the substrate. The output of the endpoint detecting sensor is monitored, and the polishing endpoint is detected when a change in the output reaches the preset film clearing level. Then, after detecting the polishing end point, by monitoring the output of the end point detecting sensor or a different sensor and performing monitoring of the remaining film for detecting a film left on a part of the substrate, the inspection on the presence of the remaining film can be performed during polishing.

In a preferred aspect of the present invention, an eddy current sensor is used for the endpoint detecting sensor or the different sensor; and a coil in the eddy current sensor for detecting an eddy current produced in the film on the substrate comprises a coil formed by winding a wire or a conductive material by a single row and plural layers; the row being defined as a direction perpendicular to the substrate and the layer being defined as a direction parallel to the substrate.

According to the present invention, by using the coil formed by winding a wire or a conductive material by a single row and plural layers for the endpoint detecting sensor or the different sensor, the coil can be brought close to the substrate and capacitance component between lines can be small, and thus the sensor sensitivity is improved and the polishing end point and the remaining film can be detected reliably.

In a preferred aspect of the present invention, the monitoring of the remaining film is performed by the different sensor having higher sensitivity than the end point detecting sensor, and the different sensor comprises the coil formed by winding a wire or a conductive material by a single row and plural layers.

According to the present invention, in the case where only the end point detecting sensor having a certain sensitivity is used from the start of polishing until detection of the polishing end point and monitoring of the remaining film, it is difficult to detect the film if the target film becomes thin or an area of the target film becomes small. On the other hand, in the case where detection of the polishing end point is performed using only a sensor for thin film, if an initial film is thick, outputs become over-range (out of measurement range), and thus the polishing process cannot be monitored. Therefore, the two sensors having different sensitivity are used, and outputs of the end point detecting sensor are monitored from the start of polishing until the end point detecting sensor has no sensitivity, and detection of the polishing end point is performed. After the detection of the polishing end point is performed, the sensor is switched from the endpoint detecting sensor to a different sensor, and the remaining film on the substrate can be detected reliably.

In a preferred aspect of the present invention, the monitoring of the remaining film is performed by switching sensitivity of the end point detecting sensor, and the switching of the sensitivity of the endpoint detecting sensor is performed by switching the number of turns of the coil.

According to the present invention, in the case where only the end point detecting sensor having a certain sensitivity is used from the start of polishing until detection of the polishing end point and monitoring of the remaining film, it is difficult to detect the film if the target film becomes thin or an area of the target film becomes small. On the other hand, in the case where detection of the polishing end point is performed using only a sensor for thin film, if an initial film is thick, outputs become over-range (out of measurement range), and thus the polishing process cannot be monitored. Therefore, by switching the number of turns of the coil, the sensor sensitivity of the end point detecting sensor can be changed into two stages, i.e., a high stage and a low stage. Thus, the outputs of the end point detecting sensor can be prevented from becoming over-range (out of measurement range) by making the sensor sensitivity low from the start of polishing until detection of the polishing end point, and the remaining film on the substrate can be reliably detected by making the sensor sensitivity high after the detection of the polishing endpoint.

In a preferred aspect of the present invention, the monitoring of the remaining film is performed by the different sensor having higher sensitivity than the end point detecting sensor; the endpoint detecting sensor and the different sensor comprise an eddy current sensor having an oscillation coil operable to produce an eddy current in the film on the substrate, a detection coil operable to detect the eddy current produced in the film on the substrate, and a balancing coil connected in series to the detection coil; and each of the oscillation coil, the detection coil and the balancing coil in the different sensor comprises a coil formed by winding a wire or a conductive material by a single row and plural layers.

According to a third aspect of the present invention, there is provided a polishing apparatus, having a polishing table with a polishing surface and a top ring for holding a substrate as an object to be polished, for polishing a film on the substrate by pressing the substrate against the polishing surface on the rotating polishing table, the polishing apparatus comprising: an end point detecting sensor provided in the polishing table for scanning a surface, being polished, of the substrate while the polishing table is rotated; a controller for monitoring an output of the end point detecting sensor obtained by scanning the surface, being polished, of the substrate and detecting a polishing end point from a change in the output of the end point detecting sensor; wherein the endpoint detecting sensor comprises an eddy current sensor: and a coil in the eddy current sensor for detecting an eddy current produced in the film on the substrate comprises a coil formed by winding a wire or a conductive material by a single row and plural layers; the row being defined as a direction perpendicular to the substrate and the layer being defined as a direction parallel to the substrate.

According to the polishing apparatus of the present invention, while the endpoint detecting sensor passes through under the substrate by rotation of the polishing table, the endpoint detecting sensor outputs a certain voltage value or the like in response to a metal film (or conductive film) of the substrate. The output of the end point detecting sensor is monitored, and the polishing end point is detected when a change in the output reaches the preset film clearing level. Since the coil of the end point detecting sensor comprises a coil formed by winding a wire or a conductive material by a single row and plural layers, the coil can be brought close to the substrate. Thus, the sensor sensitivity is improved and the polishing end point can be detected reliably.

In a preferred aspect of the present invention, the controller is operable to monitor the output of the end point detecting sensor or an output of a different sensor after detecting the polishing end point and to perform monitoring of the remaining film for detecting a film on a part of the substrate.

According to the present invention, after detecting the polishing end point, by monitoring the output of the endpoint detecting sensor or the different sensor and performing monitoring of the remaining film for detecting a film left on apart of the substrate, the inspection on the presence of the remaining film can be performed during polishing.

In a preferred aspect of the present invention, the monitoring of the remaining film is performed by the different sensor comprising an eddy current sensor having higher sensitivity than the end point detecting sensor, and the different sensor comprises a coil formed by winding a wire or a conductive material by a single row and plural layers.

According to the present invention, in the case where only the end point detecting sensor having a certain sensitivity is used from the start of polishing until detection of the polishing end point and monitoring of the remaining film, it is difficult to detect the film if the target film becomes thin or an area of the target film becomes small. On the other hand, in the case where detection of the polishing end point is performed using only a sensor for thin film, if an initial film is thick, outputs become over-range (out of measurement range), and thus the polishing process cannot be monitored. Therefore, the two sensors having different sensitivity are used, and outputs of the end point detecting sensor are monitored from the start of polishing until the end point detecting sensor has no sensitivity, and detection of the polishing end point is performed. After the detection of the polishing end point is performed, the sensor is switched from the endpoint detecting sensor to a different sensor, and the remaining film on the substrate can be detected reliably. Since the coil of the different sensor comprises a coil formed by winding a wire or a conductive material by a single row and plural layers, the coil can be brought close to the substrate. Thus, the sensor sensitivity is improved and the remaining film can be detected reliably.

In a preferred aspect of the present invention, the monitoring of the remaining film is performed by switching sensitivity of the endpoint detecting sensor, and the switching of the sensitivity of the endpoint detecting sensor is performed by switching the number of turns of the coil.

According to the present invention, in the case where only the endpoint detecting sensor having a certain sensitivity is used from the start of polishing until detection of the polishing end point and monitoring of the remaining film, it is difficult to detect the film if the target film becomes thin or an area of the target film becomes small. On the other hand, in the case where detection of the polishing end point is performed using only a sensor for thin film, if an initial film is thick, outputs become over-range (out of measurement range), and thus the polishing process cannot be monitored. Therefore, by switching the number of turns of the coil, the sensor sensitivity of the end point detecting sensor can be changed into two stages, i.e., a high stage and a low stage. Thus, the outputs of the end point detecting sensor can be prevented from becoming over-range (out of measurement range) by making the sensor sensitivity low from the start of polishing until detection of the polishing end point, and the remaining film on the substrate can be reliably detected by making the sensor sensitivity high after the detection of the polishing end point.

In a preferred aspect of the present invention, the end point detecting sensor or the different sensor comprises an eddy current sensor having an oscillation coil operable to produce an eddy current in the film on the substrate, a detection coil operable to detect the eddy current produced in the film on the substrate, and a balancing coil connected in series to the detection coil.

In a preferred aspect of the present invention, the oscillation coil comprises a coil formed by winding a wire or a conductive material by a single row and plural layers or a coil formed by winding a wire or a conductive material by plural rows and a single layer or by plural rows and plural layers.

According to the present invention, in the case where the oscillation coil of the eddy current sensor comprises a coil formed by winding a wire or a conductive material in a single row and plural layers, the oscillation frequency of coil resonance frequency can be improved, and hence the thin film can be stably detected even in an increased oscillation frequency.

In a preferred aspect of the present invention, the balancing coil comprises a coil formed by winding a wire or a conductive material by a single row and plural layers.

In a preferred aspect of the present invention, at least one of the detection coil, the oscillation coil and the balancing coil comprises the coils formed by winding a wire or a conductive material by a single row and plural layers and connected in series.

According to the present invention, plural coils formed by winding a wire or a conductive material by a single row and plural layers are arranged in a row direction and a clearance is provided between the adjacent coils so as to prevent the adjacent coils from contacting each other. A material having a low-magnetic permeability is provided in the clearance. Thus, the sensor coil can be brought close to the substrate even if the coils having a single row and plural layers are arranged in plural rows or multiple rows, thus improving sensor sensitivity.

Further, according to the present invention, plural coils having a single row and N-layers are connected in series, and thus synthetic inductance of coils is equal to the sum of the inductance of plural coils and mutual inductance between the adjacent coils. Therefore, synthetic inductance of coils increases, and sensor outputs of the entire coil increases, and thus a metal film can be detected with high accuracy.

In a preferred aspect of the present invention, the oscillation coil is curved so as to be closer to the substrate toward a radially outward edge of the oscillation coil.

According to the present invention, the oscillation coil comprises a coil formed by winding a wire or a conductive material such that the coil is curved in the form of concave sphere so as to be dented toward the balancing coil side at a radially inner side and to be closer to the detection coil side toward a radially outer side. In this manner, since the oscillation coil is curved in the form of concave sphere, an oscillation magnetic field can converge on the central area and the sensor sensitivity can be improved.

In a preferred aspect of the present invention, the detection coil and the oscillation coil may have different coil outer diameters.

According to the present invention, the outer diameter (diameter) of the detection coil is smaller than the outer diameter (diameter) of the oscillation coil (exciting coil), and the size of the detection end of the sensor can be small, and thus minute detection of metal film as a target can be performed.

In a preferred aspect of the present invention, the detection coil, the oscillation coil and the balancing coil are arranged in this order from the substrate side.

According to the present invention, it is preferable that a zero point of a detection output from the sensor coil can be adjusted automatically by the detection coil and the balancing coil. By adjusting the zero point, only a variation signal corresponding to a thickness of the metal film (or conductive film) to be measured can be amplified and detected.

In a preferred aspect of the present invention, the detection coil, the oscillation coil and the balancing coil are arranged in a concentric fashion.

According to the present invention, by arranging the detection coil, the oscillation coil and the balancing coil in a concentric fashion, the sensor coil in its entirety can be arranged closer to the substrate. Thus, the sensor sensitivity can be improved.

In a preferred aspect of the present invention, the sensor coil is housed in a tubular member made of a material having a high-magnetic permeability.

According to the present invention, a magnetic flux from the sensor coil forms a path (magnetic circuit) so as to pass through the tubular member having a high-magnetic permeability, which is located around the sensor coil and then pass through the metal film (or conductive film) to be measured. Since the magnetic flux does not pass through a member in an installation environment, the magnetic flux is not attenuated. Thus, an eddy current can effectively be produced in the metal film (or conductive film) by the sensor coil, and the metal film (or conductive film) can be measured with high sensitivity.

The present invention has the following effects:

(1) Since the detection coil of the eddy current sensor comprises a coil formed by winding a wire or a conductive material in a single row and plural layers, the detection coil can be brought close to the substrate, and capacitance component between lines can be small, thus improving sensor sensitivity. Therefore, the thin metal film (or thin conductive film) on the substrate such as a semiconductor wafer can be detected without increasing oscillation frequency, amplification degree of an internal circuit and exciting voltage of the eddy current sensor.

(2) Since the detection coil of the eddy current sensor comprises a coil formed by winding a wire or a conductive material in a single row and plural layers, the oscillation frequency of coil resonance frequency can be improved, and hence the thin metal film (or thin conductive film) can be stably detected even in an increased oscillation frequency.s (3) Plural coils having a single row and N-layers are connected in series, and thus synthetic inductance of coils is equal to the sum of the inductance of plural coils and mutual inductance between the adjacent coils. Therefore, synthetic inductance of coils increases, and sensor output of the entire coil increases, and thus a metal film can be detected with high accuracy.

(4) By performing an inspection on whether or not there is a remaining film such as a metal film (or conductive film) on a substrate such as a semiconductor wafer during polishing, inspection time can be shortened and substrate processing capability can be improved.

(5) In the case where the remaining film is detected by performing an inspection on whether or not there is a remaining film such as a metal film (or conductive film) on a substrate during polishing, additional polishing is performed as it is, and thus processing time can be shortened.

(6) In the case where the remaining film is detected by performing an inspection during polishing, because the controller for controlling the entire CMP process controls additional polishing time or the remaining film condition, it is possible to change the polishing condition of the subsequent object to be polished to the optimum condition.

(7) It is possible to perform an inspection on whether or not there is a remaining film such as a metal film (or conductive film) on a substrate such as a semiconductor wafer without separating the substrate from the polishing surface (polishing pad).

BRIEF DESCRIPTION OF THE DRAWINGS

FIG. 5A is a schematic view showing a structure of the sensor coil used in the conventional eddy current sensor;

FIG. 5B is a schematic view showing a structure of the sensor coil of an eddy current sensor of the present invention;

FIG. 5C is a schematic plan view showing a detection coil of the eddy current sensor of the present invention;

DETAILED DESCRIPTION OF THE PREFERRED EMBODIMENTS

Figure 1:
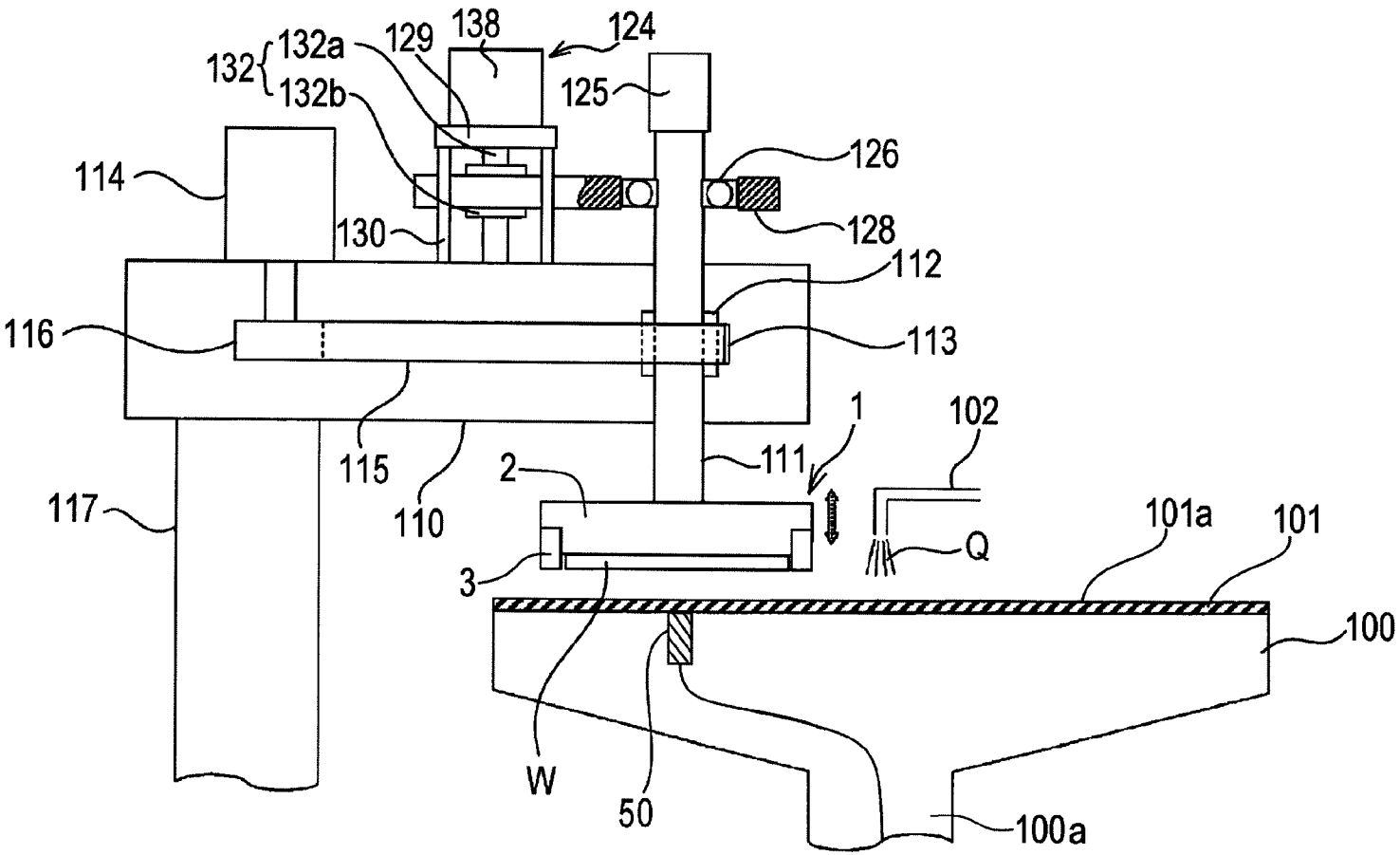
FIG. 1 is a schematic view showing an entire structure of a polishing apparatus according to the present invention.

A polishing apparatus according to embodiments of the present invention will be described below with reference to FIGS. 1 through 29. Like or corresponding structural elements are denoted by like or corresponding reference numerals in FIGS. 1 through 29 and will not be described below repetitively.

FIG. 1 is a schematic view showing an entire structure of a polishing apparatus according to the present invention. As shown in FIG. 1, the polishing apparatus comprises a polishing table 100, and a top ring 1 for holding a substrate such as a semiconductor wafer as an object to be polished and pressing the substrate against a polishing surface on the polishing table.

The polishing table 100 is coupled via a table shaft 100*a* to a motor (not shown) disposed below the polishing table 100. Thus, the polishing table 100 is rotatable about the table shaft 100*a*. A polishing pad 101 is attached to an upper surface of the polishing table 100. An upper surface 101*a* of the polishing pad 101 constitutes a polishing surface configured to polish a semiconductor wafer W. A polishing liquid supply nozzle 102 is provided above the polishing table 100 to supply a polishing liquid Q onto the polishing pad 101 on the polishing table 100. As shown in FIG. 1, an eddy current sensor 50 is embedded in the polishing table 100.

The top ring 1 basically comprises a top ring body 2 for pressing a semiconductor wafer W against the polishing surface 101*a*, and a retainer ring 3 for holding an outer peripheral edge of the semiconductor wafer W to prevent the semiconductor wafer W from being slipped out of the top ring.

The top ring 1 is connected to a top ring shaft 111, and the top ring shaft 111 is vertically movable with respect to a top ring head 110 by a vertically movable mechanism 124. When the top ring shaft 111 moves vertically, the top ring 1 is lifted and lowered as a whole for positioning with respect to the top ring head 110. A rotary joint 125 is mounted on the upper end of the top ring shaft 111.

The vertical movement mechanism 124, which vertically moves the top ring shaft 111 and the top ring 1, has a bridge 128 supporting the top ring shaft 111 in a manner such that the top ring shaft 111 is rotatable via a bearing 126, a ball screw 132 mounted on the bridge 128, a support stage 129 which is supported by poles 130, and an AC servomotor 138 provided on the support stage 129. The support stage 129, which supports the servomotor 138, is fixed to the top ring head 110 via the poles 130.

The ball screw 132 has a screw shaft 132*a* which is coupled to the servomotor 138, and a nut 132*b* into which the screw shaft 132*a* is threaded. The top ring shaft 111 is configured to be vertically movable together with the bridge 128. Accordingly, when the servomotor 138 is driven, the bridge 128 is vertically moved through the ball screw 132. As a result, the top ring shaft 111 and the top ring 1 are vertically moved.

Further, the top ring shift 111 is connected to a rotary sleeve 112 by a key (not shown). The rotary sleeve 112 has a timing pulley 113 fixedly disposed therearound. A top ring motor 114 is fixed to the top ring head 110. The timing pulley 113 is operatively coupled to a timing pulley 116 provided on the top ring motor 114 by a timing belt 115. Therefore, when the top ring motor 114 is driven, the timing pulley 116, the timing belt 115 and the timing pulley 113 are rotated to rotate the rotary sleeve 112 and the top ring shaft 111 in unison with each other, thus rotating the top ring 1. The top ring head 110 is supported on a top ring head shaft 117 which is rotatably supported by a flame (not shown).

In the polishing apparatus constructed as shown in FIG. 1, the top ring 1 is configured to hold a substrate such as a semiconductor wafer W on its lower surface. The top ring head 110 is pivotable about the top ring shaft 117. Thus, the top ring 1, which holds the semiconductor wafer W on its lower surface, is moved from a position at which the top ring 1 receives the semiconductor wafer W to a position above the polishing table 100 by pivitable movement of the top ring head 110. Then, the top ring 1 is lowered to press the semiconductor wafer W against a surface (polishing surface) 101*a* of the polishing pad 101. At this time, while the top ring 1 and the polishing table 100 are respectively rotated, a polishing liquid is supplied onto the polishing pad 101 from the polishing liquid supply nozzle 102 provided above the polishing table 100. In this manner, the semiconductor wafer W is brought into sliding contact with the polishing surface 101*a* of the polishing pad 101*a*. Thus, a surface of the semiconductor wafer W is polished.

Figure 2:
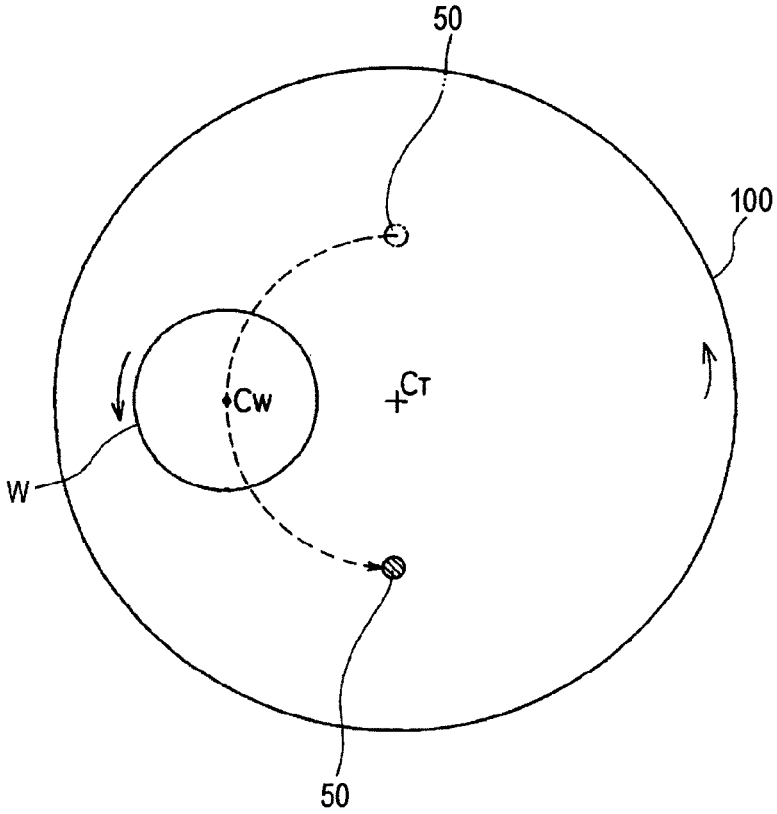
FIG. 2 is a plan view showing the relationship between a polishing table, an eddy current sensor and a semiconductor wafer.

FIG. 2 is a plan view showing the relationship between the polishing table 100, the eddy current sensor 50 and the semiconductor wafer W. As shown in FIG. 2, the eddy current sensor 50 is positioned so as to pass through the center Cw of the semiconductor wafer W held by the top ring 1 during polishing. The symbol $C_T$ represents a rotation center of the polishing table 100. For example, while the eddy current sensor 50 passes through under the semiconductor wafer W, the eddy current sensor 50 is capable of detecting a metal film (conductive film) such as a copper layer on the semiconductor wafer W continuously on a passage locus (scanning line).

Next, the eddy current sensor 50 provided on the polishing apparatus according to the present invention will be described in detail with reference to FIGS. 3 through 16.

Figure 3A:
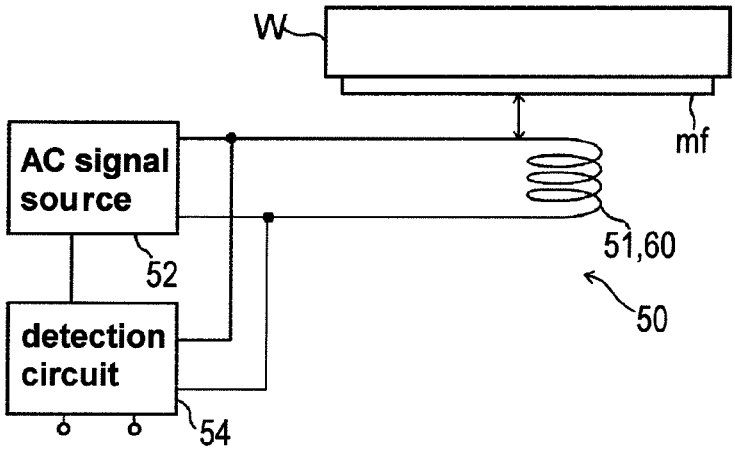
FIG. 3A is a block diagram showing the structure of the eddy current sensor.
Figure 3B:
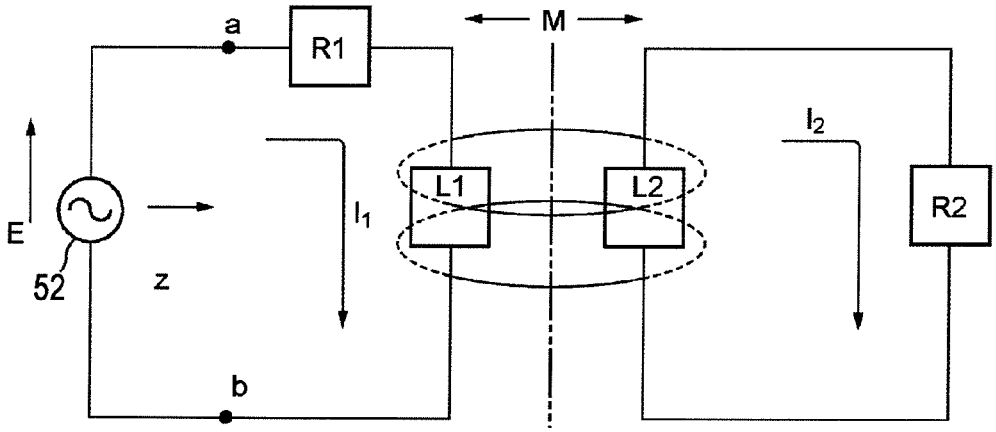
FIG. 3B is an equivalent circuit diagram of the eddy current sensor.

FIGS. 3A and 3B are views showing a structure of the eddy current sensor 50, FIG. 3A is a block diagram showing the structure of the eddy current sensor 50, and FIG. 3B is an equivalent circuit diagram of the eddy current sensor 50.

As shown in FIG. 3A, the eddy current sensor 50 comprises a sensor coil 51 or 60 disposed near a metal film (or conductive film) mf as an object to be detected, and an AC signal source 52 connected to the sensor coil 51 or 60. The metal film (or conductive film) mf as an object to be detected is, for example, a thin film of Cu, Al, Au, W, or the like formed on the semiconductor wafer W. The sensor coil 51 or 60 is a detection coil disposed near the metal film (or conductive film) to be detected, and is spaced from the metal film (or conductive film) by a distance of about 1.0 to 4.0 mm, for example.

Examples of the eddy current sensor include a frequency-type eddy current sensor which detects a metal film (or conductive film) mf based on a change in oscillation frequency that is caused by an eddy current induced in the metal film (or conductive film) mf, and an impedance-type eddy current sensor which detects a metal film (or conductive film) based on a change in impedance. Specifically, in the frequency-type eddy current sensor, as shown in the equivalent circuit of FIG. 3B, when an eddy current $I_2$ is changed, an impedance Z is changed, thus causing a change in the oscillation frequency of the signal source (variable-frequency oscillator) 52. A detection circuit 54 detects the change in the oscillation frequency, thereby detecting a change of the metal film (or conductive film). In the impedance-type eddy current sensor, as shown in the equivalent circuit of FIG. 3B, when the eddy current $I_2$ is changed, the impedance Z is changed. When the impedance Z as viewed from the signal source (variable-frequency oscillator) 52 is changed, the detection circuit 54 detects the change in the impedance Z, thereby detecting a change of the metal film (or conductive film).

In the impedance-type eddy current sensor, signal outputs X and Y, a phase, and a combined impedance Z are derived as describe later. From the frequency F, the impedances X and Y, or the like, it is possible to obtain the measurement information of a metal film (or conductive film) Cu, Al, Au or W. The eddy current sensor 50 is embedded in the polishing table 100 near its surface and faces the semiconductor wafer to be polished through the polishing pad, thereby detecting a change of the metal film (or conductive film) on the semiconductor wafer based on an eddy current flowing through the metal film (or conductive film). The frequency of the eddy current sensor may be obtained from a single radio wave, a mixed radio wave, an AM radio wave, an FM radio wave, a sweep output of a function generator, or a plurality of oscillation frequency sources. It is preferable to select a highly sensitive oscillation frequency and modulation method according to the type of metal film to be measured.

The impedance-type eddy current sensor will be described concretely below. The AC signal sensor 52 comprises an oscillator for generating a fixed frequency in the range of about 2 to 8 MHZz. A crystal quartz oscillator may be used as such an oscillator. When an alternating voltage is supplied from the AC signal source 52 to the sensor coil 51, 60, current $I_1$ flows through the sensor coil 51, 60. When the current flows through the sensor coil 51, 60 disposed near the metal film (or conductive film) mf, a magnetic flux interlinks with the metal film (or conductive film) mf, thus forming a mutual inductance M therebetween to induce an eddy current $I_2$ in the metal film (or conductive film) mf. Here, R1 represents an equivalent resistance at a primary side including the sensor coil, and L1 represents a self-inductance at a primary side also including a sensor coil. In the metal film (or conductive film) mf, R2 represents an equivalent resistance corresponding to the eddy current loss, and L2 represents a self-inductance. The impedance Z as viewed from terminals "a" and "b" of the AC signal source 52 toward the sensor coil is changed depending on the magnitude of the eddy current loss caused in the metal film (or conductive film) mf.

Figure 4:
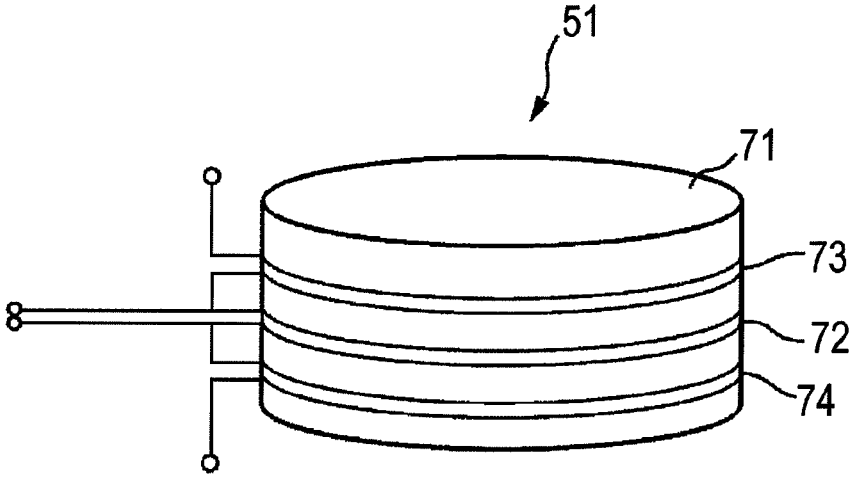
FIG. 4 is a schematic view showing a structural example of a sensor coil in the eddy current sensor.

FIG. 4 is a schematic view showing a structural example of the sensor coil in the eddy current sensor. As shown in FIG. 4, the sensor coil 51 comprises a coil for generating an eddy current in the metal film (or conductive film), and a coil, separated from the above coil, for detecting the eddy current in the metal film (or conductive film). Specifically, the sensor coil 51 comprises three coils 72, 73 and 74 wound around a bobbin 71. The central coil 72 is an oscillation coil connected to the AC signal source 52. The AC signal source 52 supplies voltage to the oscillation coil 72, and hence the oscillation coil 72 produces a magnetic field to generate an eddy current in the metal film (or conductive film) mf on the semiconductor wafer W disposed near the oscillation coil 72. The detection coil 73 is disposed at an upper side of the bobbin 71 (i.e. at the metal film (or conductive film) side) and detects a magnetic field produced by the eddy current generated in the metal film (or conductive film). The balancing coil 74 is disposed at the opposite side of the detection coil 73 with the respect to the oscillation coil 72.

Figure 5A:
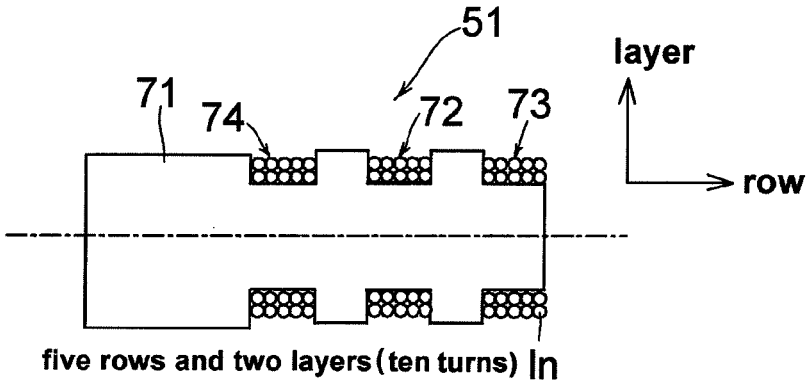
FIGS. 5A, 5B and 5C are views showing comparison between a sensor coil of a conventional eddy current sensor and a sensor coil of an eddy current sensor of the present invention.
Figure 5B:
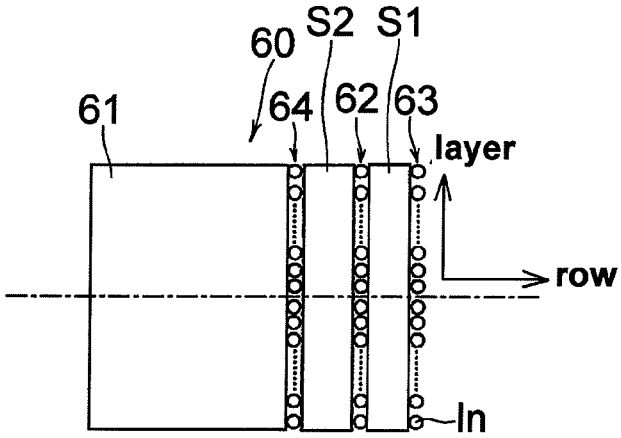
Figure 5C:
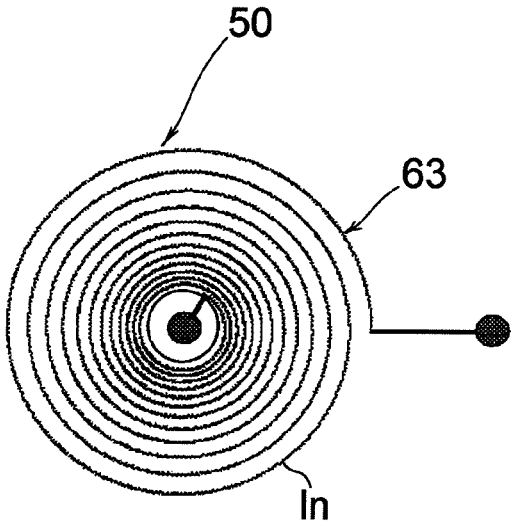

FIGS. 5A, 5B and 5C are views showing comparison between a sensor coil of a conventional eddy current sensor and a sensor coil of an eddy current sensor of the present invention. FIG. 5A is a schematic view showing a structure of the sensor coil used in the conventional eddy current sensor, FIG. 5B is a schematic view showing a structure of the sensor coil of an eddy current sensor 50 of the present invention, and FIG. 5C is a schematic plan view showing a detection coil of the eddy current sensor 50 of the present invention.

As shown in FIG. 5A, the sensor coil 51 of the conventional eddy current sensor comprises a coil for generating an eddy current in the metal film (or conductive film), and a coil, separated from the above coil, for detecting the eddy current in the metal film (or conductive film). Specifically, the sensor coil 51 comprises three coils 72, 73 and 74 wound around a bobbin 71. In order to obtain sensor sensibility, it is necessary to increase the number of turns of the coil. Therefore, each of the three coils 72, 73 and 74 in the sensor coil 51 comprises a coil formed by winding a wire ln in a solenoidal fashion by five rows and two layers (10 turns) around an outer circumference of the bobbin 71, the row being defined as a direction perpendicular to the semiconductor wafer (substrate) W and the layer being defined as a direction parallel to the semiconductor wafer (substrate) W. The central coil 72 is an oscillation coil connected to the AC signal source 52. The AC signal source 52 supplies voltage to the oscillation coil 72, and hence the oscillation coil 72 produces a magnetic field to generate an eddy current in the metal film (or conductive film) mf on the semiconductor wafer (substrate) W disposed near the oscillation coil 72. The detection coil 73 is disposed at an upper side of the bobbin 71 (i.e. at the metal film (or conductive film) side) and detects a magnetic field produced by the eddy current generated in the metal film (or conductive film). The balancing coil 74 is disposed at the opposite side of the detection coil 73 with the respect to the oscillation coil 72.

On the other hand, a sensor coil 60 in the eddy current sensor 50 of the present invention comprises three coils 62, 63, 64 which are not wound around the bobbin 61, as shown in FIG. 5B. Each of the three coils 62, 63 and 64 in the sensor coil 60 comprises a coil formed by winding a wire ln in a spiral fashion by a single row and N-layers, the row being defined as a direction perpendicular to the semiconductor wafer (substrate) W and the layer being defined as a direction parallel to the semiconductor wafer (substrate) W. More specifically, when the row is defined as a direction perpendicular to a surface having a metal film (or conductive film) of the semiconductor wafer (substrate) W and the layer is defined as a direction parallel to the surface having the metal film (or conductive film) of the semiconductor wafer (substrate) W, each of the three coils 62, 63 and 64 in the sensor coil 60 comprises a coil formed by winding a wire ln in a spiral fashion by a single row and N-layers. N is an integer not less than 2, and for example, if the number of the turns is more than or equal to the conventional one, N is not less than 10. In the example shown in FIG. 5B, the coil has a single row and 14 layers.

The central coil 62 of the three coils 62, 63, 64 is an oscillation coil connected to the AC signal source 52. The AC signal source 52 supplies voltage to the oscillation coil 62, and hence the oscillation coil 62 produces a magnetic field to generate an eddy current in the metal film (or conductive film) mf on the semiconductor wafer W disposed near the oscillation coil 62. The detection coil 63 is disposed at the metal film (or conductive film) side and detects a magnetic field produced by the eddy current generated in the metal film (or conductive film). The balancing coil 64 is disposed at the opposite side of the detection coil 63 with the respect to the oscillation coil 62. A spacer S1 is interposed between the oscillation coil 62 and the detection coil 63 to keep a distance between the oscillation coil 62 and the detection coil 63 constant. A spacer S2 is interposed between the oscillation coil 62 and the balancing coil 64 to keep a distance between the oscillation coil 62 and the balancing coil 64 constant. A bobbin 61 is disposed adjacent to the balancing coil 64. As long as a distance is provided between the oscillation coil 62 and the detection coil 63 and between the oscillation coil 62 and the balancing coil 64, only space is sufficient without providing a spacer.

As shown in FIG. 5C, the detection coil 63 comprises the coil formed by winding the wire ln radially in a spiral fashion by a single row and N-layers. The detection coil 63 may be flat so as to have a thickness corresponding to only a diameter of the wire ln in a row direction (direction perpendicular to a surface of paper in FIG. 5C) by winding the wire ln in a spiral fashion by N-layers in parallel with a surface having the metal film (or conductive film) mf of the semiconductor wafer (substrate) W. The detection coil 63 may be curved so as to have a predetermined thickness greater than the diameter of the wire ln in a row direction by winding the wire ln in a spiral fashion by N-layers so as to be closer to (or away from) the semiconductor wafer (substrate). Although the detection coil 63 is shown in FIG. 5C, the oscillation coil 62 and the balancing coil 64 have the same configuration as in FIG. 5C.

Further, each of the coils 62, 63, 64 in the sensor coil 60 may be configured to connect m number of coils, in series, formed by winding the wire ln in a spiral fashion by a single row and N-layers shown in FIG. 5C. In this case, m is an integer not less than 2. In the case where m number of coils having a single row and N-layers are connected in series, if the respective coils contact each other, then capacitance component increases. Therefore, it is preferable that m number of coils having a single row and N-layers are arranged in a row direction (direction perpendicular to the substrate) and a clearance is provided between the adjacent coils. A material having a low-magnetic permeability may be provided in the clearance.

Figure 6A:
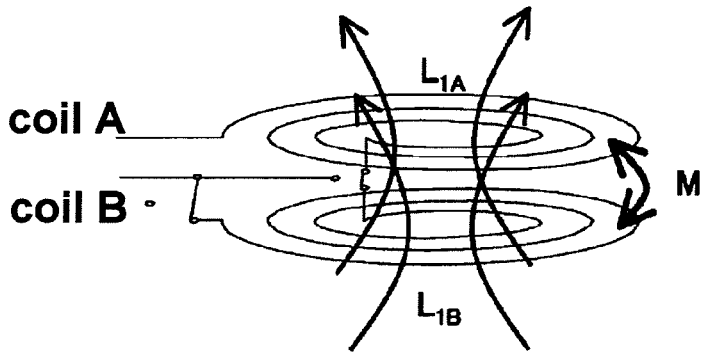
FIGS. 6A and 6B are schematic views showing embodiments in which m-number of coils having a single row and N-layers are connected in series.
Figure 6B:
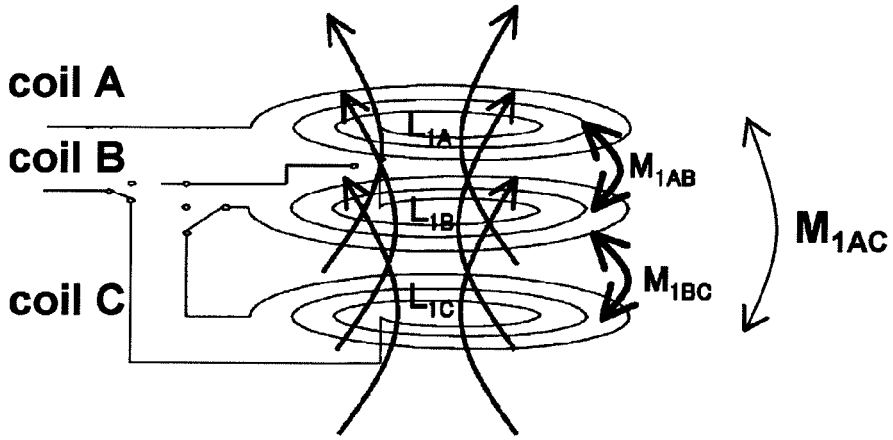

FIGS. 6A and 6B are schematic views showing embodiments in which m-number of coils having a single row and N-layers are connected in series.

In the embodiment shown in FIG. 6A, a coil A having a single row and N-layers and a coil B having a single row and N-layers are connected in series. In the embodiment of FIG. 6A, inductance $L_{1A}+L_{1B}$ of two rows of coils and mutual inductance M between adjacent coils are obtained. The mutual inductance M between the adjacent coils is expressed by the following equation:

$$M=k\sqrt{L_{1A}\cdot L_{1B}}[H]$$

Here, k is coefficient of coupling, and $L_{1A}$ and $L_{1B}$ are self-inductance [H].

Therefore, in the embodiment shown in FIG. 6A, synthetic inductance becomes $L_0=L_{1A}+L_{1B}+2M$.

In the embodiment shown in FIG. 6B, a coil A having a single row and N-layers, a coil B having a single row and N-layers and a coil C having a single row and N-layers are connected in series. In the embodiment of FIG. 6B, inductance $L_{1A}+L_{1B}+L_{1C}$ of three rows of coils and mutual inductance $M_{1AB}$, $M_{1BC}$, $M_{1AC}$ between adjacent coils are obtained. The mutual inductance $M_{1AB}$, $M_{1BC}$ and $M_{1AC}$ are expressed by the following equations:

$$M_{1AB}=k_0\sqrt{L_{1A}\cdot L_{1B}}[H]$$

$$M_{1BC}=k_1\sqrt{L_{1B}\cdot L_{1C}}[H]$$

$$M_{1AC}=k_2\sqrt{L_{1A}\cdot L_{1C}}[H]$$

Here, $k_0$, $k_1$ and $k_2$ are coefficient of coupling, and $L_{1A}$, $L_{1B}$ and $L_{1C}$ are self-inductance [H].

Therefore, in the embodiment shown in FIG. 6B, synthetic inductance becomes $L_0=L_{1A}+L_{1B}+L_{1C}+2M_{1AB}+2M_{1BC}+2M_{1AC}$.

In FIGS. 6A and 6B, two or three coils having a single row and N-layers are connected in series. In the case where m number of coils having a single row and N-layers are connected in series, synthetic inductance $L_0$ of coils is equal to the sum of the inductance of m rows and mutual inductance between m rows. Therefore, synthetic inductance of coils increases, and sensor output of the entire coil increases, and thus a metal film can be detected with high accuracy.

Further, in the embodiment shown in FIGS. 6A and 6B, by providing a switch between coils having a single row and N-layers, the number of coils which are connected in series can be suitably selected. Therefore, the number of coils (the number of rows) in each of the detection coil 63, the oscillation coil (exciting coil) 62 and the balancing coil (dummy coil) 64 is switched depending on metal film to be detected or film thickness to be detected, and optimum detection can be performed. For example, in the case where film thickness of the metal film is small or resistance value of metal is low, the number of coils (the number of rows) can be increased. In FIGS. 6A and 6B, there may be no space (clearance) between the adjacent coils, but preferably there should be a space (clearance) between the adjacent coils of the coil A, the coil B, the coil C, and the like. Then, a material having a low-dielectric constant may be provided in the space (clearance).

Figure 7:
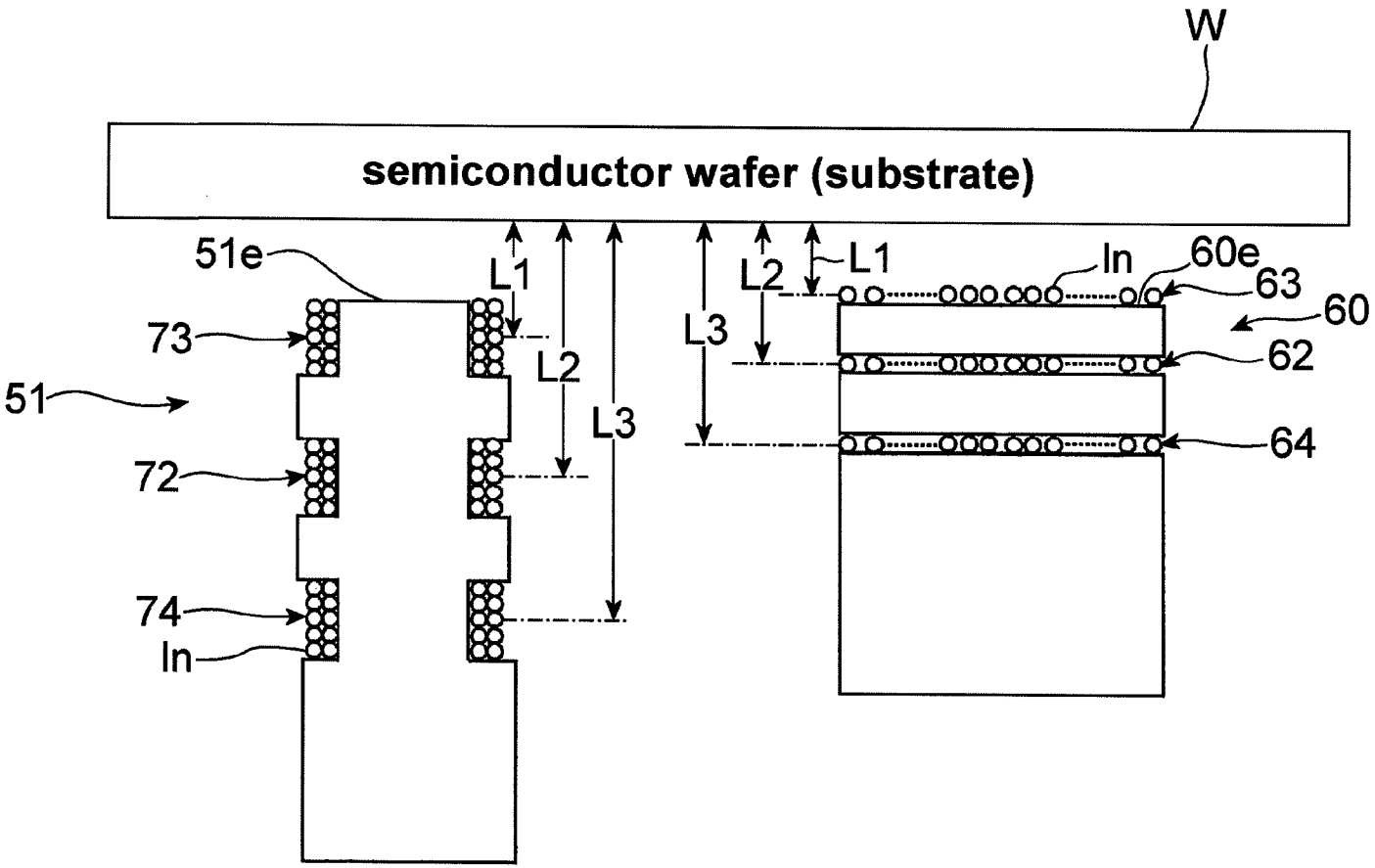
FIG. 7 is a schematic elevational view showing a positional relationship between the sensor coil in the conventional eddy current sensor and the semiconductor wafer (substrate) and between the sensor coil in the eddy current sensor of the present invention and the semiconductor wafer (substrate)

FIG. 7 is a schematic elevational view showing a positional relationship between the sensor coil 51 in the conventional eddy current sensor and the semiconductor wafer (substrate) and between the sensor coil 60 in the eddy current sensor of the present invention and the semiconductor wafer (substrate). As shown in FIG. 7, in the case where a detection edge 51*e* of the conventional sensor coil 51 and a detection edge 60*e* of the sensor coil 60 of the eddy current sensor of the present invention are positioned at the same height, the sensor coil 60 of the eddy current sensor of the present invention is characterized in that the sensor coil 60 can be positioned closer to the semiconductor wafer W than the sensor coil 51 of the conventional eddy current sensor.

In order to obtain sensor sensibility, it is necessary to increase the number of turns of the coil. The conventional solenoidal sensor coil 51 has five rows and two layers (10 turns) because the wire ln is wound around the bobbin (including an air core), and thus distances (L1, L2, L3) between the respective coils 73, 72, 74 in the sensor coil 51 and the semiconductor wafer W become large.

Because the sensor coil 60 of the present invention does not need to be wound around the bobbin, the number of turns of the coil can be large in a condition that thicknesses of the respective coils 63, 62, 64 are thin by winding the respective coils 62, 63, 64 in a spiral fashion by a single row and N-layers. Therefore, the distances (L1, L2, L3) between the respective coils 63, 62, 64 in the sensor coil 60 and the semiconductor wafer W can be small, and hence the sensor sensitivity is improved. Further, by making the number of turns of the coil large, L component increases and the sensitivity is improved.

In the conventional solenoidal winding, as the number of turns of the coil increases, the coil resonance frequency is lowered, and capacitance component between lines increases because of parallel connection. Because the coil resonance frequency cannot be high in practice, the frequency oscillated from the coil cannot be high.

In contrast, in the case of the spiral winding of the present invention, because the coil is wound by a single row and N-layers, the capacitance component between lines can be small because of series connection. Because the number of turns of the coil can be large, the resonance frequency is increased while the L component is kept high, and the oscillation frequency can be increased.

Although the spiral winding coil is illustrated in FIGS. 5B and 5C, the same effects can be obtained by other winding as long as the coil is wound by a single row and N-layers.

Figure 8:
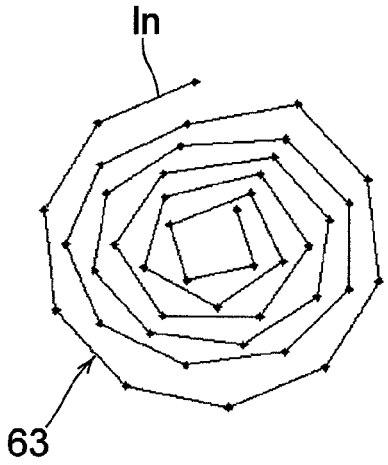
FIG. 8 is a schematic view showing a sensor coil formed by other winding.
Figure 9:
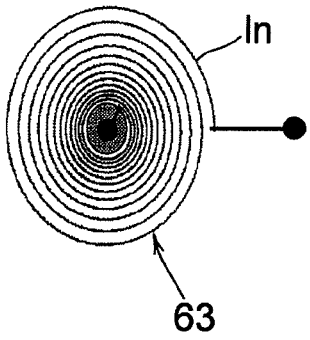
FIG. 9 is a schematic view showing a sensor coil formed by other winding.
Figure 10:
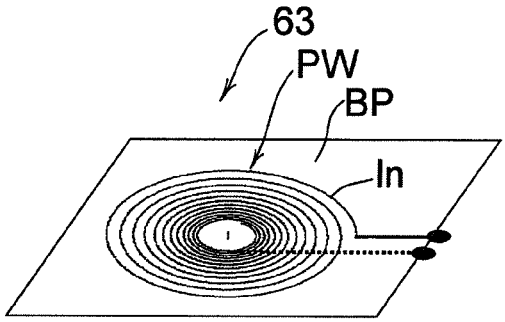
FIG. 10 is a schematic view showing a sensor coil formed by other winding.

FIGS. 8 through 10 are schematic views showing sensor coils having a single row and N-layers formed by other winding.

In the example shown in FIG. 8, the detection coil 63 is formed by winding a wire ln in a polygonal shape by a single row and N-layers. As shown in FIG. 8, as the wire is wound from radially inner side toward radially outer side, the number of the angles of the polygonal shape may increase, or may be the same like a polygonal shape having only triangles or quadrangles.

In the example shown in FIG. 9, the detection coil 63 is formed by winding a wire ln in an elliptical shape by a single row and N-layers.

In the example shown in FIG. 10, the detection coil 63 comprising a pattern coil is formed by printed wiring (PW) applied to a predetermined substrate BP so as to wind a conductive material ln in a spiral fashion by a single row and N-layers. The pattern coil having a single row and N-layers formed by a conductive material ln may be produced by processing such as etching or wire cutting of metal material (Cu film, Cu foil, Cu material or the like), other than the printed wiring. The metal material may be other material such as AL than Cu.

Although several windings of the wire or the conductive material ln are applied to the detection coil 63 in the examples shown in FIGS. 8 through 10, such windings can be applied to the oscillation coil 62 and the balancing coil 64.

Figure 11:
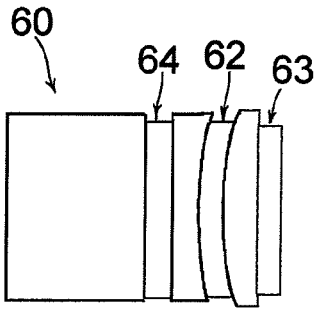
FIG. 11 is a schematic view showing an example in which the oscillation coil is formed into the form of concave sphere.

FIG. 11 is a schematic view showing an example in which the oscillation coil 62 among the three coils 62, 63, and 64 of the sensor coil 60 is formed into the form of concave sphere. As shown in FIG. 11, the oscillation coil 62 comprises a coil formed by winding a wire such that the coil is curved in the form of concave sphere so as to be dented toward the balancing coil side at a radially inner side and to be closer to the detection coil side toward a radially outer side. In this manner, since the oscillation coil 62 is curved in the form of concave sphere, an oscillation magnetic field can converge on the central area and the sensor sensitivity can be improved.

Figure 12:
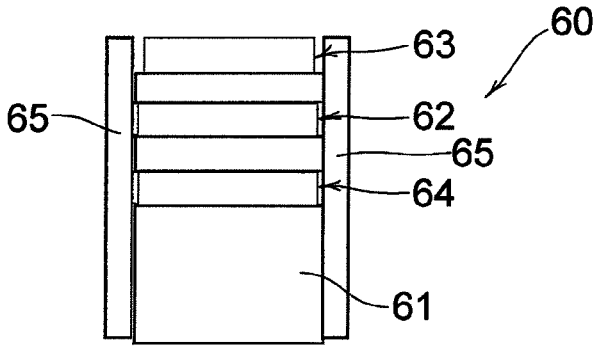
FIG. 12 is a schematic view showing an example in which a tubular member made of a material having a high-magnetic permeability is disposed around the sensor coil shown in FIG. 5B.

FIG. 12 is a schematic view showing an example in which a tubular member made of a material having a high-magnetic permeability is disposed around the sensor coil shown in FIG. 5B. As shown in FIG. 12, the bobbin 61 and the three coils 62, 63, 64 in the sensor coil 60 are housed in a tubular member 65 made of a material having a high-magnetic permeability. The tubular member 65 is made of a material having a high-magnetic permeability, for example, ferrite, amorphous, permalloy, supermalloy, or mumetal so that the relative permeability μ is 50. Thus, the tubular member 65 can pass 50 times as much magnetic flux as in the case where the environment surrounding the sensor coil is air. In other words, the tubular member can pass an equivalent magnetic flux with one-fiftieth thickness of an electrically-insulating material such as a ceramic material disposed around the sensor coil.

As shown in FIG. 12, since the tubular member 65 made of a material having a high-magnetic permeability is disposed around the sensor coil, even when the polishing table 100 is made of a conductive material such as a stainless (SUS) material, a current is supplied to the oscillation coil 62 of the sensor coil 60 disposed in the tubular member 65 to produce a magnetic flux. Thus, an eddy current is not produced in the polishing table by the magnetic flux and paths (magnetic circuits) of the magnetic flux, which are required for measurement, are not reduced. Accordingly, it is possible to maintain paths so as to effectively produce an eddy current in the metal film of the semiconductor wafer W. Specifically, the tubular member 65 serves as a path to prevent the magnetic flux produced by the oscillation coil 62 of the sensor coil 60 from passing through a conductive base material of the polishing table 100 and to expand the magnetic flux into the detection space on the semiconductor wafer W. Thus, the magnetic flux can produce a large amount of an eddy current in the metal film (conductive film) mf to be measured. Therefore, even in the case of the polishing table 100 made of a conductive material such as a stainless (SUS), it is possible to maintain the same sensitivity as in the case of the polishing table 100 made of a ceramics material (insulating material) such as SiC.

Figure 13:
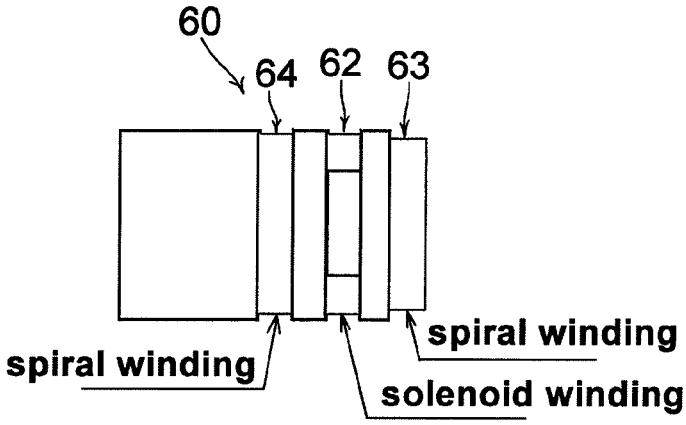
FIG. 13 is a schematic view showing an example of combining solenoid winding and spiral winding in the three coils of the sensor coil of the eddy current sensor.

FIG. 13 is a schematic view showing an example of combining solenoid winding and spiral winding in the three coils 62, 63, 64 of the sensor coil 60 of the eddy current sensor 50. By winding the detection coil 63 spirally in a single row and N-layers, the detection coil 63 can be disposed closer to the wafer, and the capacitance component between lines can be small because of series connection. Therefore, the sensitivity of the detection coil 63 can be improved. From the above reason, as shown in FIG. 13, even if the oscillation coil 62 is wound by the conventional solenoidal winding, the sensor has higher sensitivity than the conventional sensor. The oscillation coil 62 may be composed of M-layers formed by a plurality of coils formed by winding a wire or a conductive material ln in a solenoidal fashion by N-rows and a single layer. M is an integer not less than 2. In the case of fabricating the coils having N-rows and a single layer into M-layers, if the adjacent coils are brought into contact with each other, the capacitance component increases. Therefore, it is preferable that M number of the coils having N-rows and a single layer are arranged in a layer direction (direction parallel to the substrate) and a clearance is provided between the adjacent coils. A material having a low-magnetic permeability may be provided in this clearance. Because the balancing coil 64 and the detection coil 63 constitute a bridge circuit (described later), it is preferable that the coils 63 and 64 having identical characteristics are used. Therefore, as shown in FIG. 13, the spiral winding is adopted for the balancing coil 64.

Next, an embodiment in which minute detection of the metal film can be performed by making a size (diameter) of the coil small will be described.

Figure 14:
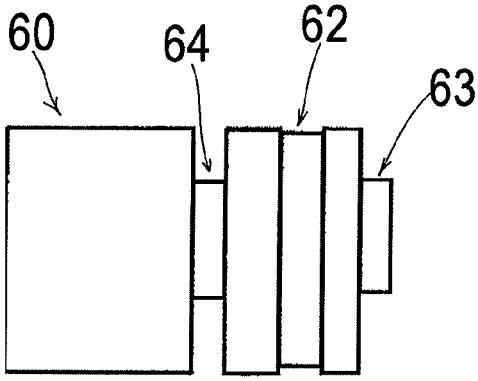
FIG. 14 is a schematic view showing an embodiment in which diameters (outer diameters) of the detection coil, the oscillation coil (exciting coil) and the balancing coil (dummy coil) are varied.

FIG. 14 is a schematic view showing an embodiment in which diameters (outer diameters) of the detection coil 63, the oscillation coil (exciting coil) 62 and the balancing coil (dummy coil) 64 are varied. As shown in FIG. 14, the detection coil 63, the oscillation coil 62 and the balancing 64 are not required to have the same diameter (outer diameter), and the oscillation coil 62, the detection coil 63 and the balancing 64 may have different diameters. In the embodiment shown in FIG. 14, the diameters of detection coil 63 and the balancing coil 64 are smaller than the diameter of the oscillation coil 62, thereby reducing a size of a detection end of the sensor. Thus, minute detection of metal film as a target can be performed.

As a method for making the diameter of the coil small, it is considered that the number of turns is reduced, and a diameter of wire (pattern width) and a distance between wires (pattern) are reduced. As the size of the coil becomes smaller, the sensor output becomes smaller. Therefore, it is necessary that the oscillation coil (exciting coil) is structurally large or multistage. However, the sensor output can be improved by increasing exciting frequency or exciting current.

The detection coil formed by winding a wire or a conductive material by a single row and N-layers in a spiral, polygonal, or elliptical fashion can be used for a sensor which comprises a Colpitts circuit formed by connecting the detection coil and a condenser in parallel to have excitation and detection function, thereby detecting a polishing end point from a frequency change of excitation frequency.

Figure 15:
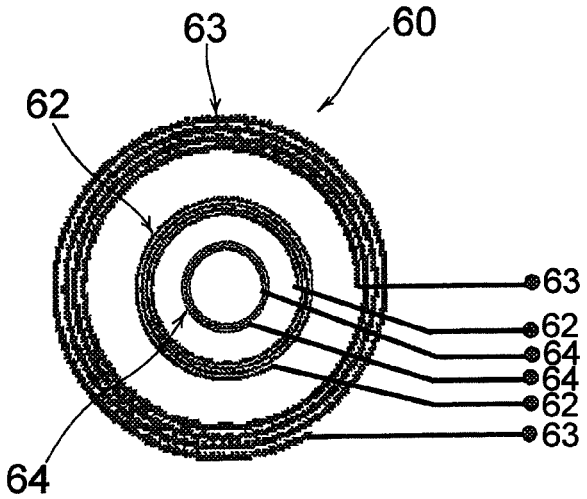
FIG. 15 is a schematic view showing an example in which the three coils in the sensor coil of the eddy current sensor are arranged in a concentric fashion.

FIG. 15 is a schematic view showing an example in which the three coils 62, 63, 64 in the sensor coil 60 of the eddy current sensor 50 are arranged in a concentric fashion.

As shown in FIG. 15, the three coils 62, 63, 64 in the sensor coil 60 of the eddy current sensor 50 are arranged in a concentric fashion. Among the three coils 62, 63, 64, the detection coil 63 is arranged at the most outer circumferential side, the coil 62 is arranged at the intermediate portion, and the balancing coil 64 is arranged at the most inner circumferential side. The respective three coils 62, 63, 64 are formed by winding a wire or a conductive material ln in a spiral fashion by a single row and N-layers, and can be formed integrally by printed wiring.

According to the sensor coil 60 formed by arranging the three coils 62, 63, 64 in a concentric fashion as shown in FIG. 15, the sensor coil in its entirety can be arranged closer to the semiconductor wafer (substrate) W at the position of the distance L1 from the semiconductor wafer W shown in FIG. 7. Thus, the sensor sensitivity can be improved.

Figure 16A:
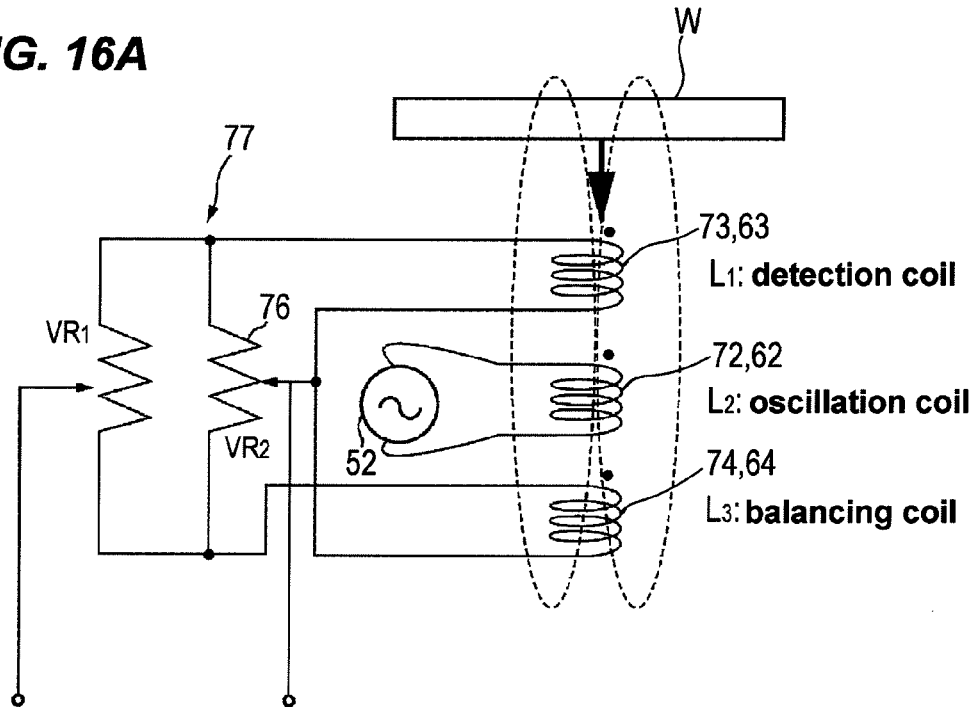
FIGS. 16A, 16B and 16C are schematic views showing a connected configuration of the coils of the sensor coil.
Figure 16B:
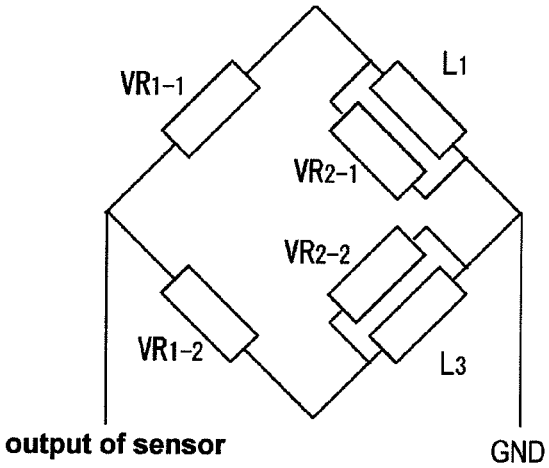
Figure 16C:
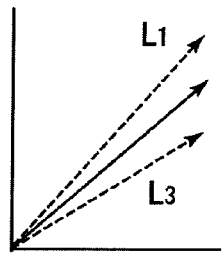

FIGS. 16A, 16B and 16C are schematic views showing a connected configuration of the coils of the sensor coil. As shown in FIG. 16A, the coils 72, 73 and 74; 62, 63 and 64 have the same number of turns (1 to 20 turns), and the detection coil 73, 63 and the balancing coil 74, 64 are connected in negative-phase to each other.

The detection coil 73, 63 and the balancing coil 74, 64 constitute a negative-phase series circuit whose terminal ends are connected to a resistance bridge circuit 77 including variable registers 76. The coil 72, 62 is connected to the AC signal source 52, and produces an alternating magnetic flux to generate an eddy current in the metal film (or conductive film) mf that is disposed closely to the coil 72, 62. By adjusting the resistances of the variable resistors 76, an output voltage of the series circuit having the coils 73 and 74; 63 and 64 can be adjusted such that the output voltage is zero when no metal film (or conductive film) is present nearby. The variable resistors 76 ($VR_1$, $VR_2$) are connected in parallel to the coils 73 and 74; 63 and 64, and are adjusted to keep signals $L_1$ and $L_3$ in phase with each other. Specifically, in the equivalent circuit of FIG. 16B, the variable resistors $VR_1(=VR_{1-1}+VR_{1-2})$, $VR_2$ $(=VR_{2-1}+VR_{2-2})$ are adjusted to satisfy the following equation:

$$VR_{1-1}\times(VR_{2-2}+j\omega L_3)=VR_{1-2}\times(VR_{2-1}+j\omega L_1) \quad (1)$$

In this manner, as shown in FIG. 16C, the signals $L_1$ and $L_3$ (indicated by the dotted lines) are transformed to have the same phase and the same amplitude as each other as indicated by the solid line.

When the metal film (or conductive film) is present near the detection coil 73, 63, the magnetic flux produced by the eddy current generated in the metal film (or conductive film) interlinks with the detection coil 73, 63 and the balancing coil 74, 64. Since the detection coil 73, 63 is positioned closer to the metal film (or conductive film) than the balancing coil 74, 64, induced voltage of the coils 73 and 74; 63 and 64 are brought out of balance, thus enabling the detection of the flux linkage produced by the eddy current flowing through the metal film (or conductive film). A zero point can be adjusted by separating the series circuit having the detection coil 73, 63 and the balancing coil 74, 64 from the oscillation coil 72, 62 connected to the AC signal source and adjusting the balance with use of the resistance bridge circuit. Therefore, the eddy current flowing through the metal film (or conductive film) can be detected from the zero point, and thus the eddy current generated in the metal film (or conductive film) can be detected with an increased sensitivity. Therefore, a magnitude of the eddy current flowing through the metal film (or conductive film) can be detected in a wide dynamic range.

Figure 17:
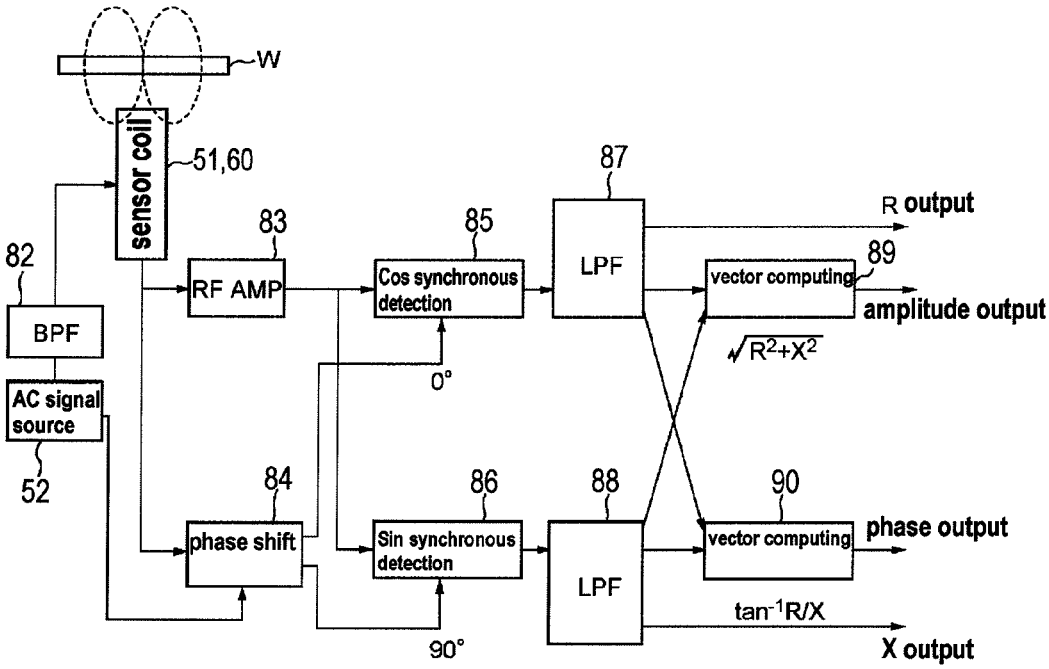
FIG. 17 is a block diagram showing a synchronous detection circuit of the eddy current sensor.

FIG. 17 is a block diagram showing a synchronous detection circuit of the eddy current sensor. FIG. 17 shows an example of a circuit for measuring the impedance Z as viewed from the AC signal source 52 toward the sensor coil 51, 60. The impedance measuring circuit shown in FIG. 17 can extract a resistance component (R), a reactance component (X), an amplitude output (Z), and a phase output ($\tan^{-1}R/X$), which vary depending on the change in the film thickness.

As described above, the AC signal source 52 supplies an AC signal to the sensor coil 51, 60 disposed closely to the semiconductor wafer W having the metal film (or conductive film) mf to be detected. The AC signal source 52 comprises a fixed-frequency type oscillator such as a crystal quartz oscillator. The AC signal source 52 supplies voltage having a fixed frequency of 2 MHz or 8 MHz, for example. The AC voltage generated by the AC signal source 52 is sent through a band-pass filter 82 to the sensor coil 51, 60. A signal detected at the terminal of the sensor coil 51, 60 is supplied through a high-frequency amplifier 83 and a phase shift circuit 84 to a synchronous detection unit comprising a cos synchronous detection circuit 85 and a sin synchronous detection circuit 86. The synchronous detection unit extracts a cos component and a sin component of the detected signal. The oscillation signal generated by the AC signal source 52 is supplied to the phase shift circuit 84 where the oscillation signal is resolved into two signals, i.e. an in-phase component (0°) and an orthogonal component (90°). These two signals are introduced respectively to the cos synchronous detection circuit 85 and the sin synchronous detection circuit 86, thereby performing the above synchronous detection.

The synchronous detection signals are supplied to low-pass filters 87 and 88 which remove unnecessary high-frequency components from the synchronously detected signals, thereby extracting a resistance component (R) as the cos synchronous detection output and a reactance component (X) as the sin synchronous detection output. A vector computing circuit 89 derives an amplitude $(R^2+X^2)^{1/2}$ from the resistance component (R) and the reactance component (X). Further, a vector computing circuit 90 derives a phase output ($\tan^{-1}R/X$) from the resistance component (R) and the reactance component (X). Here, the measuring device has various types of filters for removing noise components from the sensor signal. These filters have their respective cutoff frequencies. For example, a low-pass filter has a cutoff frequency in the range of 0.1 to 10 Hz for removing noise components which have been mixed into the sensor signal while the semiconductor wafer is being polished. Thus, the metal film (conductive film) to be measured can be measured with a high accuracy.

Figure 18A:
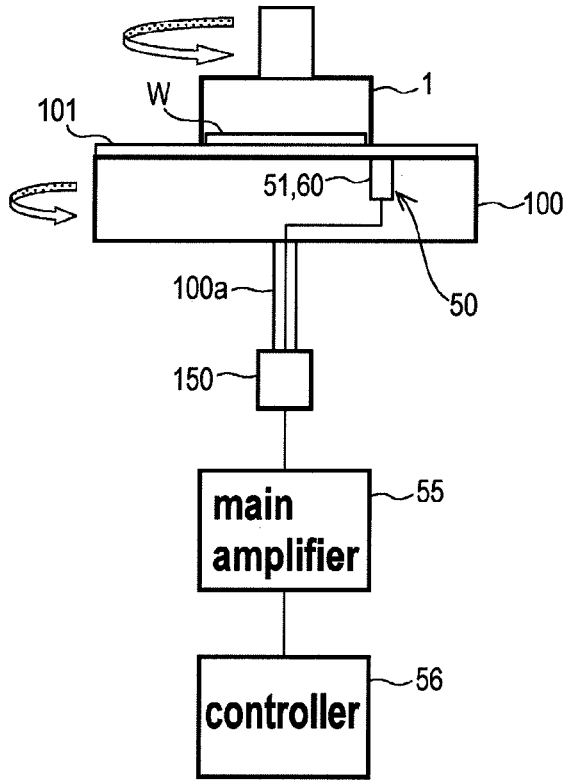
FIG. 18A is a view showing an entire structure of the polishing apparatus including a control unit of the eddy current sensor.
Figure 18B:
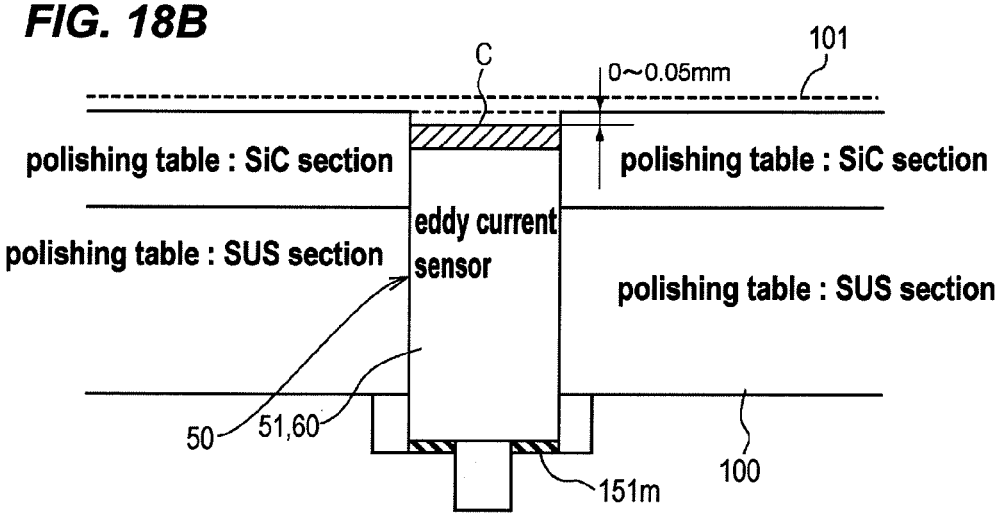
FIG. 18B is an enlarged cross-sectional view of an eddy current sensor section.

FIGS. 18A and 18B are views showing an essential structure of the polishing apparatus having the eddy current sensor. FIG. 18A is a view showing an entire structure of the polishing apparatus including a control unit of the eddy current sensor, and FIG. 18B is an enlarged cross-sectional view of an eddy current sensor section. As shown in FIG. 18A, the polishing table 100 is rotatable about its own axis as indicated by the arrow. The sensor coil 51, 60 having an integrated preamplifier including the AC signal source and the synchronous detection circuit is embedded in the polishing table 100. A connection cable of the sensor coil 51, 60 extends through the table shaft 100*a* and a rotary joint 150 mounted on a shaft end of the table shaft 100*a*, and the sensor coil 51, 60 is connected to a controller 56 through a main amplifier 55 by the connection cable. The sensor coil 51, 60 may be provided with the main amplifier 55 integrally.

The controller 56 has a various type of filters for removing noise components from the sensor signal. These various types of filters have their respective cutoff frequencies. For example, a low-pass filter has a cutoff frequency in the range of 0.1 to 10 Hz to remove noise components which have been mixed into the sensor signal while the semiconductor wafer is being polished. Thus, the metal film (or conductive film) to be measured can be measured with a high accuracy.

As shown in FIG. 18B, a polishing-pad-side end of the eddy current sensor 50 embedded in the polishing table 100 has a coating C made of a fluorine-based resin such as tetrafluoroethylene for preventing the eddy current sensor from being removed from the polishing table when the polishing pad is removed from the polishing table. The polishing-pad-side end of the eddy current sensor is provided at a position where the upper end of the eddy current sensor is lower than an upper surface (surface facing the polishing pad) of the polishing table made of SiC or the like by a distance ranging from 0 to 0.05 mm, so that the eddy current sensor is prevented from contacting the wafer during polishing. The difference in position between the upper surface of the polishing table and the upper end of the eddy current sensor should be as small as possible. In the actual apparatus, the difference in position is generally set to about 0.02 mm. The position of the eddy current sensor is adjusted by an adjustment mechanism such as a shim (thin plate) 151*m* or a screw.

The rotary joint 150 serves to interconnect the sensor coil 51, 60 and the controller 56. The rotary joint 150 can transmit signals through its rotating section, but has a limitation in the number of signal lines for transmitting the signals. Thus, the signal lines to be connected to the rotary joint are limited to eight signal lines, which are a DC voltage source line, an output signal line, and transmission lines for various types of control signals. The sensor coil 51, 60 has its oscillation frequency switchable from 2 MHz to 8 MHz, and the gain of the preamplifier is also switchable according to the type of film to be polished.

Next, a method of detecting and monitoring a metal film (or conductive film) on the semiconductor wafer during polishing in the polishing apparatus having the eddy current sensor constructed as shown in FIGS. 1 through 18 will be described below in detail.

Figure 19B:
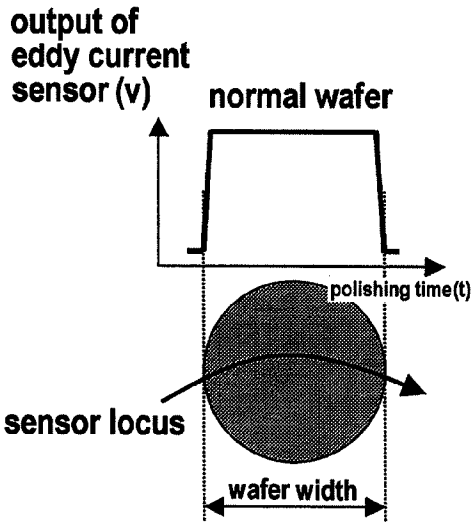
FIG. 19B is a view showing an output of the eddy current sensor in the case of normal semiconductor wafer.
Figure 19A:
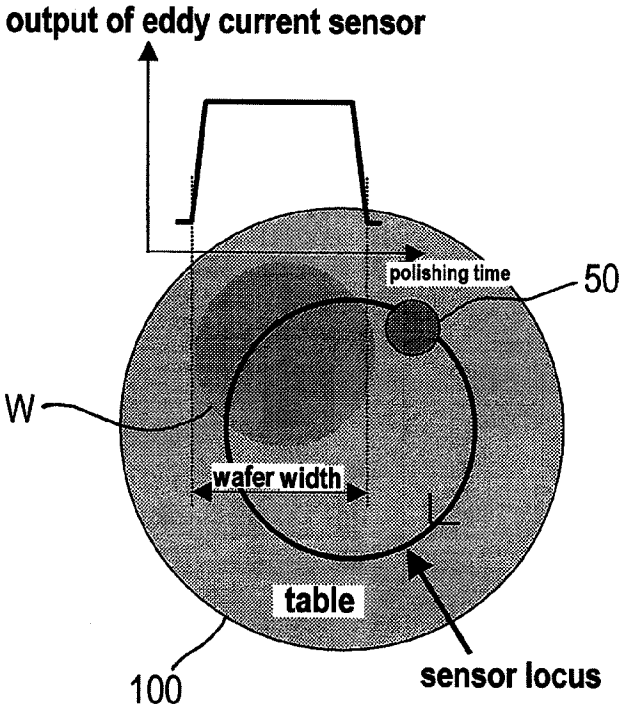
FIG. 19A is a view showing the relationship between a locus described when the eddy current sensor scans a surface (surface to be polished) of the semiconductor wafer and an output of the eddy current sensor.

FIG. 19A shows the relationship between a locus described when the eddy current sensor 50 scans a surface (surface to be polished) of the semiconductor wafer W and an output of the eddy current sensor 50. As shown in FIG. 19A, while the eddy current sensor 50 passes through under the semiconductor wafer W by rotation of the polishing table 100, the eddy current sensor 50 outputs a certain voltage value (V) in response to a metal film (or conductive film) mf of the semiconductor wafer W.

FIG. 19B is a view showing an output of the eddy current sensor 50 in the case of normal semiconductor wafer W. In FIG. 19B, the horizontal axis represents polishing time (t), and the vertical axis represents an output value (voltage value) (V) of the eddy current sensor 50. As shown in FIG. 19B, in the case of the normal semiconductor wafer W, the eddy current sensor 50 generates an output (voltage value) in the form of substantially rectangular pulse in response to a metal film (or conductive film) mf on the semiconductor wafer W.

Figure 20A:
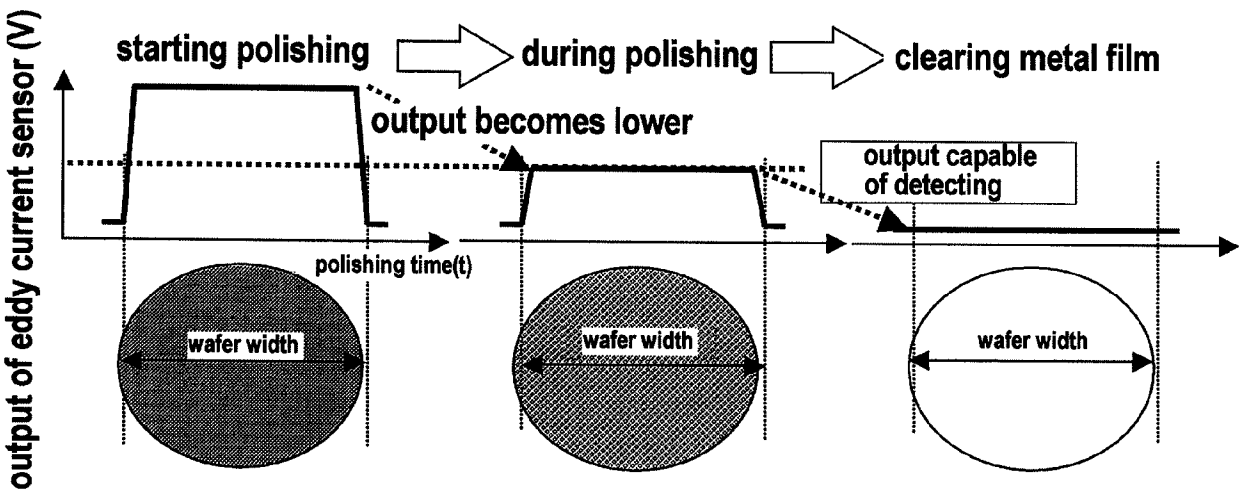
FIG. 20A is a view showing the relationship between a polishing process from starting polishing of the semiconductor wafer to clearing (removing) of a metal film (or conductive film) on the semiconductor wafer and outputs of the eddy current sensor.

FIG. 20A is a view showing the relationship between a polishing process from starting polishing of the semiconductor wafer W to clearing (removing) of a metal film (or conductive film) mf on the semiconductor wafer W and outputs of the eddy current sensor 50. As shown in FIG. 20A, the output of the eddy current sensor 50 is high immediately after starting polishing of the semiconductor wafer W, because the metal film (or conductive film) mf is thick. Then, an output of the eddy current sensor 50 becomes lower with progress of polishing, because the metal film mf becomes thinner. When the metal film mf is cleared (removed), the output value of the eddy current sensor 50 disappears.

Figure 20B:
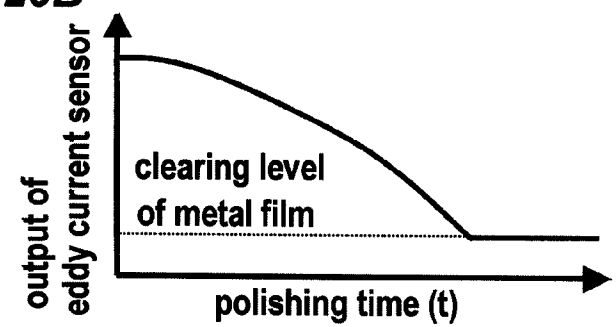
FIG. 20B is a view showing the relationship between the polishing time (t) from starting polishing of the semiconductor wafer to clearing (removing) of a metal film (or conductive film) mf on the semiconductor wafer and a change in an output value of the eddy current sensor.

FIG. 20B is a view showing the relationship between the polishing time (t) from starting polishing of the semiconductor wafer W to clearing (removing) of a metal film (or conductive film) mf on the semiconductor wafer W and a change in an output value of the eddy current sensor 50. When the polishing table 100 makes one revolution to allow the eddy current sensor 50 to scan the surface (surface to be polished) of the semiconductor wafer W, the eddy current sensor 50 generates an output in the form of substantially rectangular pulse. Every time the eddy current sensor 50 scans the surface of the semiconductor wafer W one time, the controller 56 (see FIG. 18) outputs an average value as an output value which is obtained by averaging output values at respective measuring points on a passage locus (scanning line). Then, the controller 56 monitors the output value as the average value obtained by averaging the output values at the respective measuring points of the eddy current sensor 50 every time the polishing table makes one revolution, and continues to monitor the output value until the output value of the eddy current sensor 50 disappears.

FIG. 20B shows a change in the output value (average value) of the eddy current sensor 50 with polishing time. As shown in FIG. 20B, by monitoring the output value of the eddy current sensor 50, it is possible to detect the state where the metal film is uniformly cleared.

Figure 21:
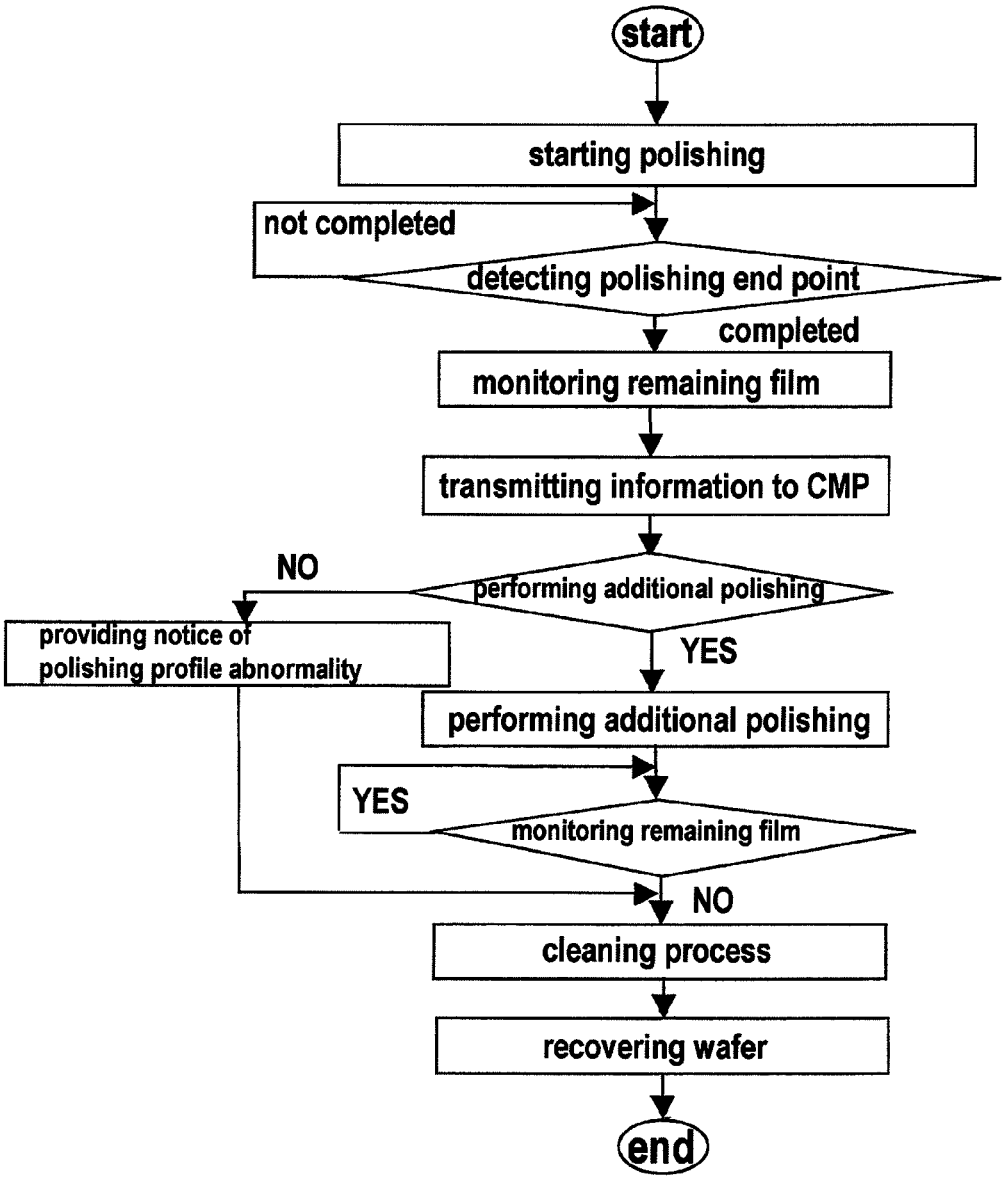
FIG. 21 is a flow chart showing a procedure of a polishing process and a monitoring process of a metal film (or conductive film) on the semiconductor wafer.

FIG. 21 is a flow chart showing a procedure of a polishing process and a monitoring process of a metal film (or conductive film) mf on the semiconductor wafer W.

As shown in FIG. 21, in the polishing apparatus, a semiconductor wafer W is takes out from a wafer cassette and transferred to the top ring 1, and the semiconductor wafer W is pressed against the polishing surface 101*a* on the polishing table 100 by the top ring 1, thereby starting polishing of the semiconductor wafer W. After polishing is started, the controller 56 monitors the output values of the eddy current sensor 50, and continues polishing until detection of a polishing end point and continues a monitoring process of the output values of the eddy current sensor 50. The detection of the polishing end point is to detect no remaining metal film uniformly on the semiconductor wafer W by detecting that the output value of the eddy current sensor 50 becomes the clear level of the metal film. After the polishing end point is detected, the process is shifted to monitoring of the remaining film without separating the semiconductor wafer W from the polishing surface (polishing pad).

Monitoring of the remaining film is performed by arbitrarily selecting the following methods:

(1) Switching of sensor sensitivity of the eddy current sensor (2) Switching of monitoring method (3) Switching to an optical sensor The remaining film monitoring methods raised in the above (1)-(3) will be described later in detail.

Next, information obtained by monitoring of the remaining film is transmitted to the controller (process controller (not shown)) for controlling the entire CMP process. The controller (process controller) for controlling the entire CMP process may comprise a single controller including the above controller 56 or a controller different from the controller 56. The controller (process controller) judges whether or not additional polishing is necessary on the basis of the information of monitoring of the remaining film. If it is judged that the additional polishing is necessary, the additional polishing is performed, and the monitoring of the remaining film is performed. Then, after it is confirmed that there is no remaining film, the process is shifted to a cleaning process. On the other hand, if it is judged that the CMP process has some trouble, the additional polishing is not performed, but a notice of polishing profile abnormality is provided, and then the process is shifted to the cleaning process. The cleaning process is performed such that after the polished semiconductor wafer is removed from the top ring 1, scrubbing cleaning, deionized water cleaning, drying and the like are carried out by a cleaning machine in the polishing apparatus. After the cleaning process is terminated, the polished semiconductor wafer W is recovered into the wafer cassette.

Next, the monitoring of the remaining film and the additional polishing in the flow chart shown in FIG. 21 will be further described.

The monitoring of the remaining film is performed during water-polishing or overpolishing after the substantial polishing process of the wafer. Here, the water-polishing is defined as "polishing is performed by small surface pressure applied to the wafer while supplying deionized water (water) to the polishing surface." Further, the overpolishing is defined as "after detecting a characteristic point, polishing is performed while a slurry is supplied to the polishing surface."

The monitoring of the remaining film is performed using the following methods:

(1) A method of performing the monitoring of the remaining film by increasing sensor sensitivity for the purpose of detecting a thin metal film.

(2) A detection method of shifting a range where monitoring is performed for detecting a local remaining film from an average of accumulation value of point data to point data.

(3) A method of monitoring the remaining film using an optical sensor which is insusceptible to the lower layer of the wafer.

The monitoring of the remaining film is performed by combining the above (1), (2) and (3) arbitrarily. In this case, it is possible to detect a thin metal film in a local area by combining the above (1) and (2) methods. Further, the above method (3) may be performed in parallel.

Further, in the case of detecting the remaining film, the additional polishing is performed in the following manner.

As a means for performing the additional polishing, in the case where the remaining film is detected during overpolishing, the polishing time of the overpolishing is changed. Further, in the case where the remaining film is detected at a specific location on the wafer by the monitoring of the remaining film, the additional polishing is performed by changing pressure of the top ring at the detected specific location, or the additional polishing is performed under a dedicated polishing condition. The additional polishing condition is fed back to a polishing condition for polishing a subsequent semiconductor wafer and thereafter.

Next, among the remaining film monitoring methods, the method of performing the monitoring of the remaining film by increasing sensor sensitivity for the purpose of detecting the thin metal film will be described in detail.

In the case where only a sensor (sensor A) having a certain sensitivity is used from the start of polishing until clearing of a target metal film, it is difficult to detect the metal film if the target metal film becomes thin or an area of the target metal film becomes small. On the other hand, in the case where detection of a polishing endpoint is performed using only a sensor for thin film (sensor B), if an initial metal film is thick, outputs become over-range (out of measurement range), and thus the polishing process cannot be monitored.

Therefore, according to the present invention, the two sensors A and B having different sensitivity are used, and outputs of the sensor A are monitored from the start of polishing until the sensor A has no sensitivity, and then detection of a polishing end point is performed. Thereafter, the sensor is switched from the sensor A to the sensor B, and it is confirmed that there is no remaining metal film on the wafer.

In this case, the eddy current sensor comprising the three coils 72, 73 and 74 formed by solenoid winding shown in FIG. 5A is used for the sensor A, and the eddy current sensor comprising the three coils 62, 63 and 64 formed by spiral winding shown in FIG. 5B is used for the sensor B. This enables the sensor A to be a sensor having low sensor sensitivity and the sensor B to be a sensor having high sensor sensitivity.

Further, by switching the number of turns of the coil by using the eddy current sensor comprising the three coils 62, 63, 64 formed by winding a wire by a single row and N-layers in a spiral, polygonal, or elliptical fashion as shown in FIG. 5B, FIG. 8, FIG. 9, FIG. 10 and so on, two sensors, i.e., the sensor A and the sensor B which have different sensitivity can be constructed.

Figure 22A:
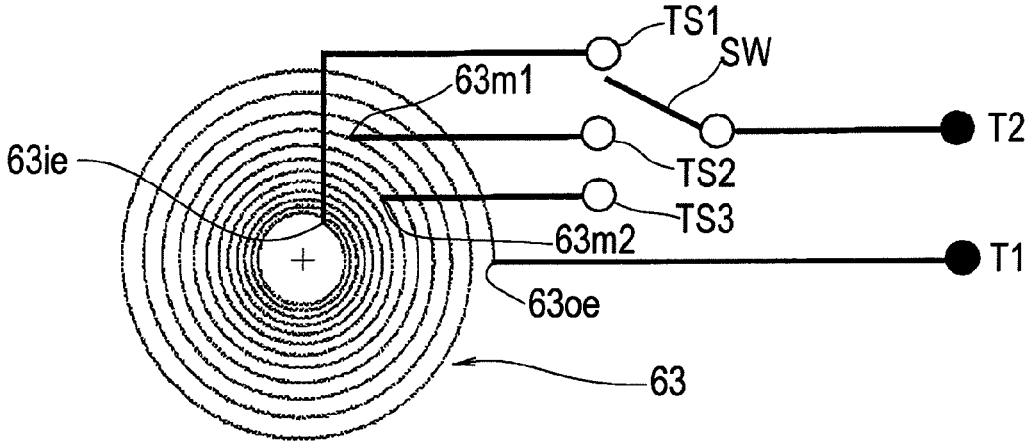
FIGS. 22A and 22B are schematic plan views showing a method of constructing two sensors having different sensitivity by switching the number of turns of the coil using the eddy current sensor which comprises the three coils formed by spiral winding.
Figure 22B:
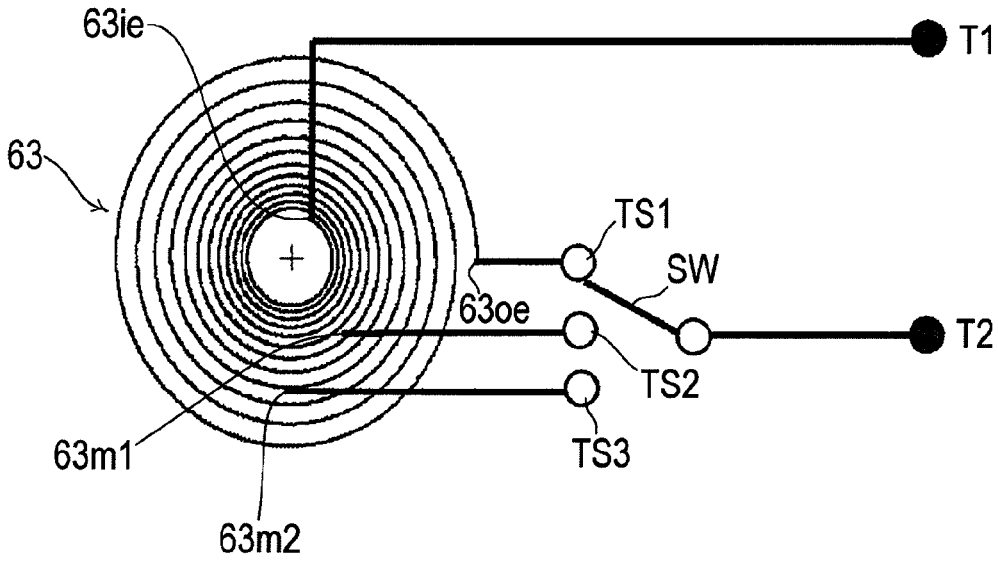

FIGS. 22A and 22B are schematic plan views showing a method of constructing two sensors A and B having different sensitivity by switching the number of turns of the coil using the eddy current sensor which comprises the three coils formed by spiral winding. In FIGS. 22A and 22B, a method of switching the number of turns of the detection coil 63 is shown. However, the same method of switching the number of turns may be used in the oscillation coil 62 and the balancing coil 64.

As shown in FIG. 22A, input terminals T1 and T2 for supplying current to the detection coil 63 formed by spiral winding are provided. The input terminal T1 is connected to an outer circumferential end portion 63*oe* of the detection coil 63 and the input terminal T2 is connected to a switch SW. On the other hand, an inner circumferential end portion 63*ie* of the detection coil 63 is connected to a switching terminal TS1, and intermediate portions 63*m*1 and 63*m*2 of the detection coil 63 are connected to switching terminals TS2 and TS3, respectively.

As shown in FIG. 22B, input terminals T1 and T2 for supplying current to the detection coil 63 formed by spiral winding are provided. The input terminal T1 is connected to an inner circumferential end portion 63*ie* of the detection coil 63 and the input terminal T2 is connected to a switch SW. On the other hand, an outer circumferential end portion 63*oe* of the detection coil 63 is connected to a switching terminal TS1, and intermediate portions 63*m*1 and 63*m*2 of the detection coil 63 are connected to switching terminals TS2 and TS3, respectively.

In the detection coil 63 configured as shown in FIGS. 22A and 22B, by connecting the switch SW to the switching terminal TS1, current can be supplied between the inner circumferential end portion 63*ie* and the outer circumferential end portion 63*oe* of the detection coil 63 from the input terminals T1 and T2. In this case, the number of turns of the coil becomes maximum. Further, by connecting the switch SW to the switching terminal TS2 or TS3, current can be supplied between the intermediate portion 63*m*1 or 63*m*2 and the outer circumferential end portion 63*oe* (or the inner circumferential end portion 63*ie*) from the input terminals T1 and T2. In this case, the number of turns becomes small. In this manner, by changing the number of turns of the coil into two stages or three stages, the sensor sensitivity can be changed and by switching the number of turns of the coil using a single detection coil 63, the sensor A and the sensor B can be constructed.

Further, as shown in FIG. 13, the eddy current sensor comprising the sensor coil 60 formed with the detection coil 63 and the balancing coil 64 wound in a spiral fashion and with the oscillation coil 62 wound in a solenoidal fashion can be used as the sensor A, and the eddy current sensor comprising the three coils 62, 63 and 64 wound in a spiral fashion shown in FIG. 5B can be used as the sensor B.

Figure 23:
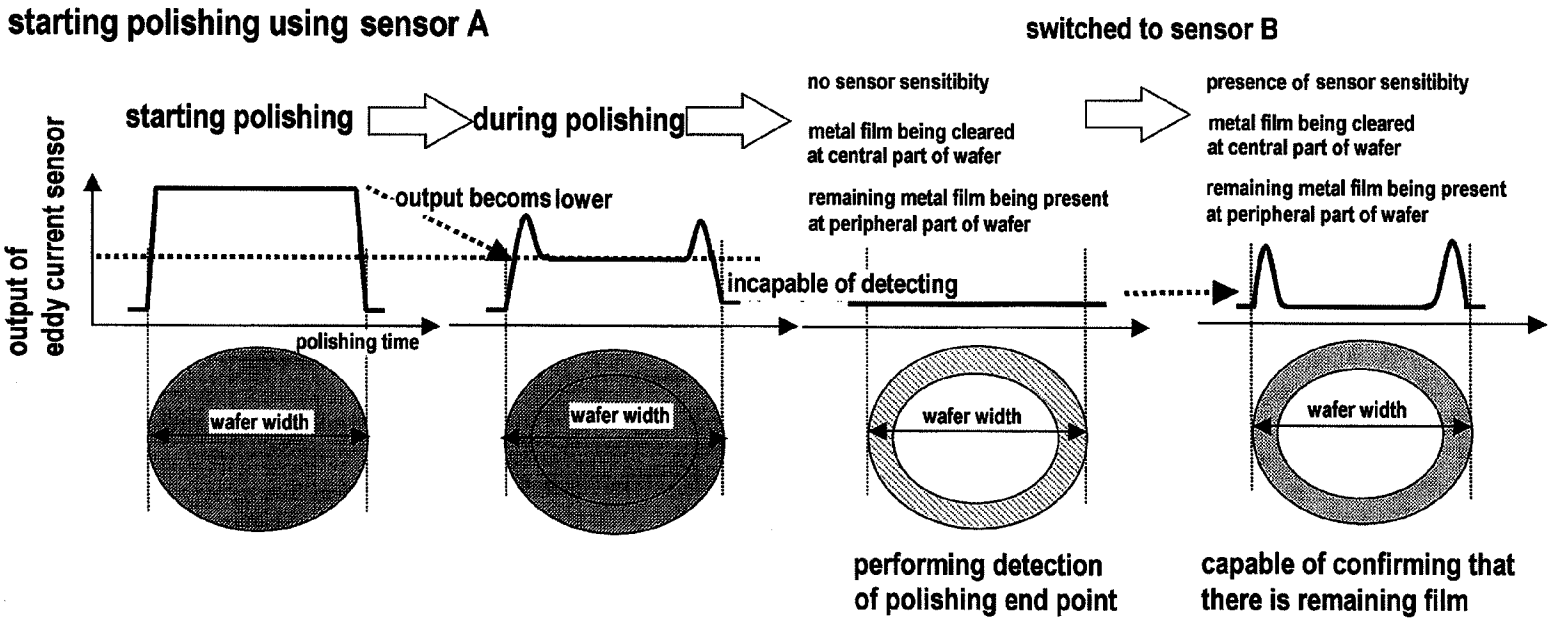
FIG. 23 is a schematic view showing a timing of switching of the sensor in the method of performing the monitoring of the remaining film by increasing sensor sensitivity for the purpose of detecting the thin metal film.

FIG. 23 is a schematic view showing a timing of switching of the sensor in the method of performing the monitoring of the remaining film by increasing sensor sensitivity for the purpose of detecting the thin metal film. As shown in FIG. 23, because the metal film (or conductive film) mf is thick at the start of polishing of the semiconductor wafer W, an output of the sensor A becomes high. Then, with progress of polishing, the metal film mf becomes thinner and the output of the sensor A becomes lower. Then, when the state of "the metal film being cleared at the central part of the wafer/the remaining metal film being present at the peripheral part of the wafer" occurs, the sensor A becomes the state of no sensor sensitivity. Therefore, the sensor A performs detection of the polishing end point. After the sensor A performs detection of the polishing end point, the sensor is switched from the sensor A to the sensor B. Because the sensor B has higher sensitivity than the sensor A, the output value at the peripheral side of the wafer becomes large in the form of a mountain, and thus the sensor B can detect the state of "the metal film being cleared at the central part of the wafer/the remaining metal film being present at the peripheral part of the wafer."

Next, among the remaining film monitoring methods, the method of switching the monitoring means for the purpose of detecting the local remaining film on the wafer will be described in detail.

In order to obtain information about generation location of the remaining film, a size of the remaining film and a film thickness of the remaining film, the monitoring method is switched from monitoring based on an output value obtained by averaging data at all measuring points obtained by one scanning to monitoring based on output values at respective measuring points. In the case where there is a remaining film which is located not at the entire circumferential area but at the local area, when the remaining film passes through on the locus of the sensor, the output value is changed. The distance from the edge portion (or center) of the wafer can be grasped from the change in the output value. In this case, it is possible to monitor the thin metal film by switching sensor sensitivity.

Figure 24A:
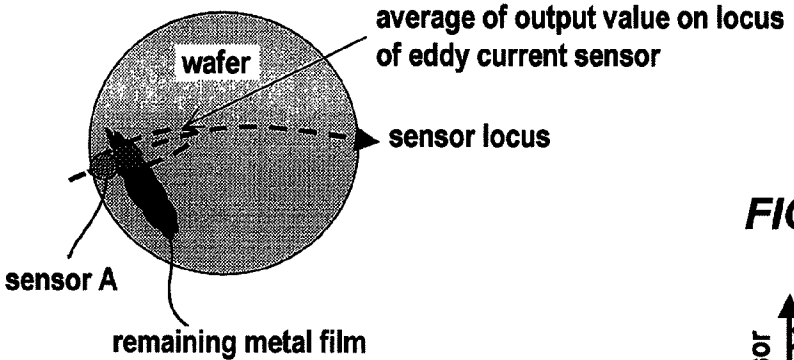
FIG. 24A is a view showing a method of changing a monitoring means for the purpose of detecting the local remaining film on the wafer and showing a monitoring means which uses an output value obtained by averaging data at all measuring points on the sensor locus obtained by one scanning.
Figure 24B:
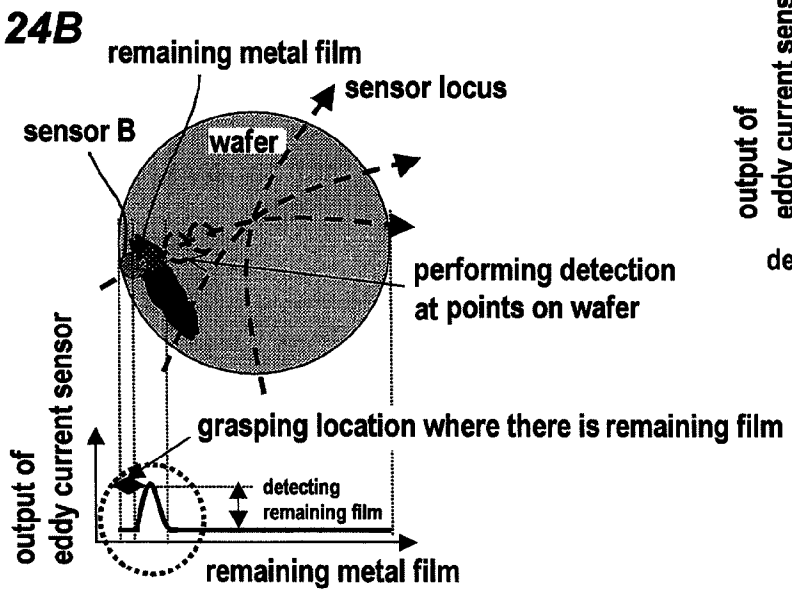
FIG. 24B is a view showing a method of changing a monitoring means for the purpose of detecting the local remaining film on the wafer and showing a monitoring means which uses output values at respective measuring points on the sensor locus obtained by one scanning.
Figure 24C:
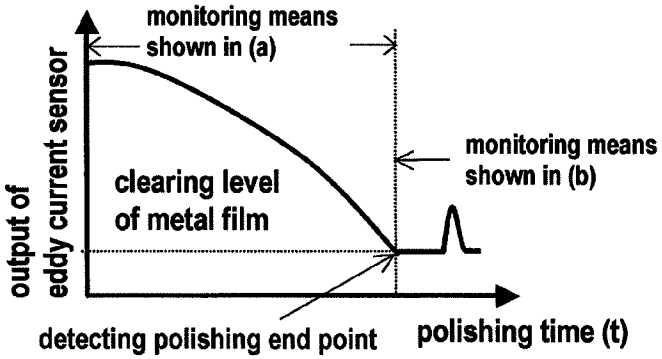
FIG. 24C is a graph showing the case in which the monitoring means is switched from the monitoring means shown in FIG. 22A to the monitoring means shown in FIG. 22B.

FIGS. 24A and 24B are views showing a method of changing the monitoring means for the purpose of detecting the local remaining film on the wafer. FIG. 24A shows a monitoring means which uses an output value obtained by averaging data at all measuring points on the sensor locus obtained by one scanning, FIG. 24B shows a monitoring means which uses output values at respective measuring points on the sensor locus obtained by one scanning, and FIG. 24C is a graph showing the case in which the monitoring means is switched from the monitoring means shown in FIG. 24A to the monitoring means shown in FIG. 24B. In FIG. 24C, the horizontal axis represents polishing time (t), and the vertical axis represents output values (voltage value) (V) of the eddy current sensor.

As shown in FIG. 24A, every time the eddy current sensor 50 scans the surface of the semiconductor wafer one time, monitoring is performed using an output value obtained by averaging data measured at all measuring points. Then, as shown in FIG. 24C, detection of a polishing end point is performed by monitoring the output value obtained by averaging data at all measuring points on the locus of the sensor A. When the detection of the polishing end point is performed by the sensor A, clearing level of the metal film is reached. In this case, the thin metal film having a small local area cannot be detected because the output values at such small local area are averaged.

Therefore, after the polishing end point is detected, the sensor is switched from the sensor A to the sensor B having higher sensitivity. As shown in FIG. 24B, every time the sensor B scans the surface of the semiconductor wafer one time, the sensor B generates output values measured at respective measuring points. Thus, in the case where there is a remaining film, the sensor B generates output values in the form of a mountain as shown at the lower part of FIG. 24B, and hence it is possible to detect the thin metal film. Further, it is possible to grasp the location where there is a remaining film. Specifically, as shown in FIG. 24C, after the polishing end point is detected by monitoring the output value obtained by averaging the outputs of the sensor A, the sensor is switched from the sensor A to the sensor B, and then the remaining film having a local small area can be detected by monitoring the output values of the respective measuring values which are not averaged in the sensor B.

Figure 25B:
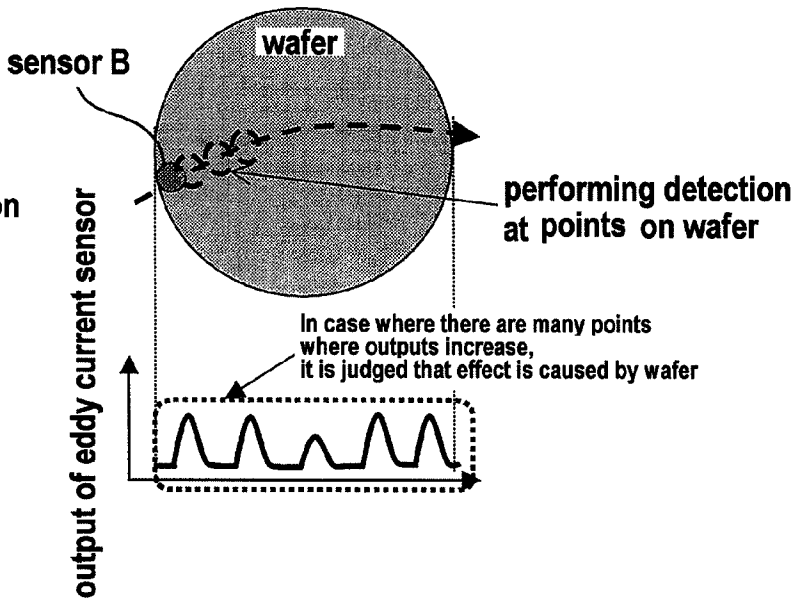
FIG. 25B is a view showing an effect of metal interconnections or the like located at the lower layer of the wafer in the case of detecting generation of the local remaining film by monitoring output values of respective measuring values obtained by the eddy current sensor and showing the case in which there is an effect of the metal interconnections or the like located at the lower layer of the wafer.
Figure 25A:
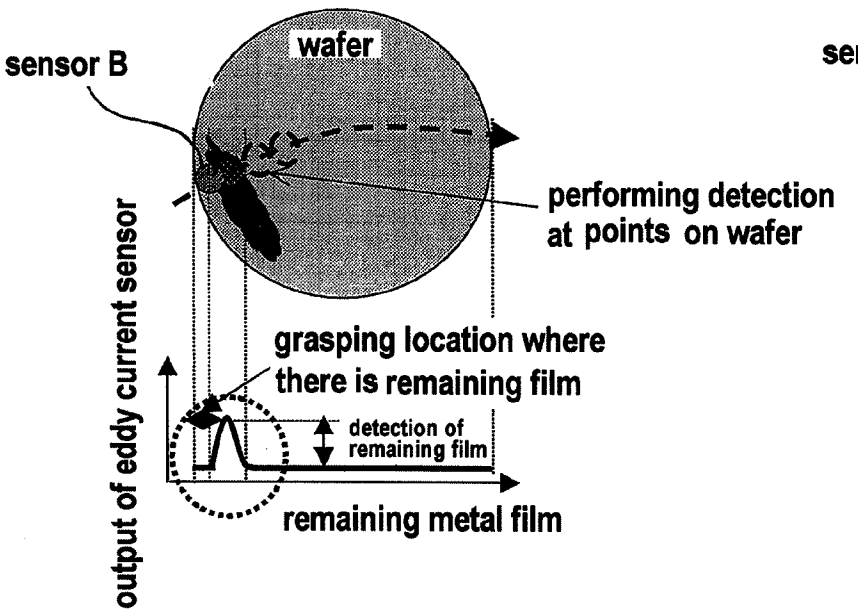
FIG. 25A is a view showing an effect of metal interconnections or the like located at the lower layer of the wafer in the case of detecting generation of the local remaining film by monitoring output values of respective measuring values obtained by the eddy current sensor and showing the case in which there is no effect of the lower layer of the wafer.

FIGS. 25A and 25B are views showing an effect of metal interconnections or the like located at the lower layer of the wafer in the case of detecting generation of the local remaining film by monitoring output values of respective measuring values obtained by the sensor B. FIG. 25A shows the case in which there is no effect of the lower layer of the wafer, and FIG. 25B shows the case in which there is an effect of the metal interconnections or the like located at the lower layer of the wafer.

As described above, it is possible to avoid an effect of the metal interconnections located at the lower layer of the wafer by averaging outputs on the locus of the sensor A passing through the wafer plane. On the other hand, because the sensor B generates the output values measured at respective measuring points, as shown in FIG. 25A, generation of the remaining film having a small local area can be detected by monitoring output values of the respective measuring values obtained by the sensor B without averaging processing. However, because the output values of the sensor B correspond to output values at the respective measuring points, there is a possibility that there is an effect of the metal interconnections or the like located at the lower layer of the wafer. Therefore, as shown in FIG. 25B, in the case where there are many points where the outputs increases, it is judged that the effect is caused not by the remaining film but by the lower layer of the wafer.

Next, among the remaining film monitoring methods, the method of monitoring a remaining film using an optical sensor will be described in detail. As shown in FIG. 24A, every time the eddy current sensor scans the surface of the semiconductor wafer one time, monitoring is performed using an output value obtained by averaging data measured at all measuring points. Then, the polishing endpoint is detected by monitoring an output value obtained by averaging data at all measuring points on the locus of the eddy current sensor. When the polishing end point is detected by the eddy current sensor, clearing level of the metal film is reached. After the polishing end point is detected, the sensor is switched from the eddy current sensor to an optical sensor separately provided in the polishing table.

The optical sensor comprises a light-emitting element and a light-detecting element, and the light-emitting element applies light to the surface, being polished, of the semiconductor wafer W and the light-detecting element receives reflected light from the surface being polished. In this case, the light-emitting element may apply a laser beam or light of LED to the surface of the semiconductor wafer. In some cases, the light-emitting element may utilize white light. The polishing pad 101 (see FIG. 1) has a cylindrical light-transmittable window member mounted therein for allowing light from the optical sensor to pass therethrough. Alternatively, a small through-hole is provided in the polishing pad 101, and when the through-hole comes under the wafer, a space surrounded by the through-hole and the wafer surface may be filled with liquid having light transmitting capability.

In many cases, the remaining film of the metal member such as Cu is in the form of a circular line or spots on the wafer surface, and thus it is possible to distinguish color of the remaining film visually. Therefore, in the case of Cu, for example, by applying light having a high reflectance wavelength of about 700 to 800 nm, or monitoring a reflected light in view of the light having the same wavelength while the light-transmittable window member or the through-hole monitors under the wafer, the remaining film at the local area can be detected by capturing the timing when the reflection intensity increases temporarily.

Next, a method capable of selecting the case where additional polishing is performed by the CMP or the case where a notice of polishing profile abnormality is provided in the case where the remaining film is detected in the remaining film monitoring process in the flow chart shown in FIG. 21 will be described in detail.

In the case where the remaining film is detected by the remaining film monitoring process, the additional polishing is usually performed to remove the metal film. However, in some case, the CMP process has some trouble even if planarization of the wafer is kept by the additional polishing, and hence a notice of the polishing profile abnormality can be given to the controller of the polishing apparatus.

Next, a locus (scanning line) described when the eddy current sensor 50 scans a surface of the semiconductor wafer will be described.

Thus, in the present invention, a ratio of the rotational speeds of the top ring 1 and the polishing table 100 is adjusted such that the loci of the eddy current sensor 50 described on the semiconductor wafer W within a predetermined period of time (e.g., within a moving average time) are distributed substantially evenly over an entire circumference of the surface of the semiconductor wafer W.

Figure 26:
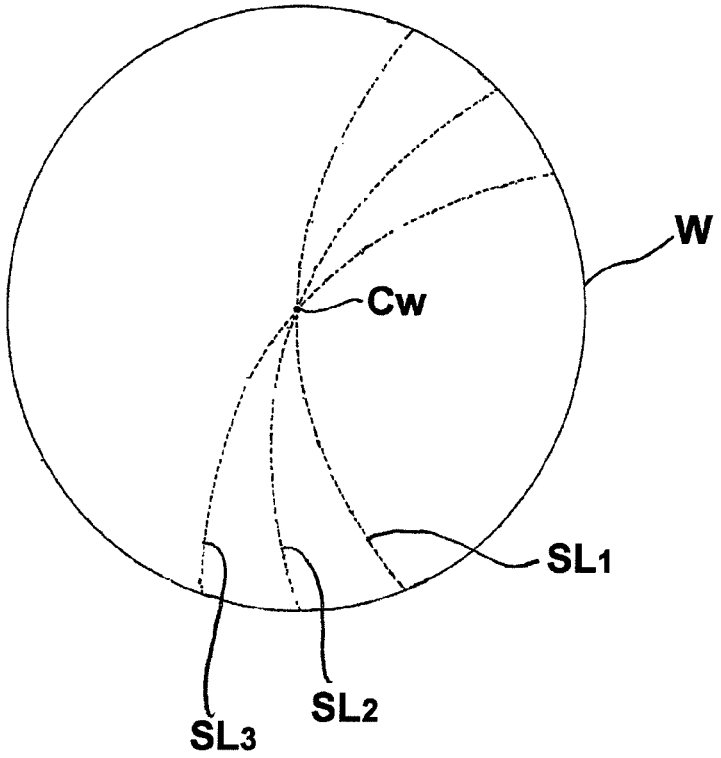
FIG. 26 is a schematic view showing loci of the eddy current sensor sweeping across the semiconductor wafer.

FIG. 26 is a schematic view showing loci of the eddy current sensor 50 sweeping across the semiconductor wafer W. As shown in FIG. 26, the eddy current sensor 50 scans the surface (surface to be polished) of the semiconductor wafer W each time the polishing table 100 makes one revolution. Specifically, when the polishing table 100 is being rotated, the eddy current sensor sweeps across the surface, being polished, of the semiconductor wafer W in a locus passing through the center $C_w$ of the semiconductor wafer W (center of the top ring shaft 111). A rotational speed of the top ring 1 is set to be different from a rotational speed of the polishing table 100. Therefore, the locus of the eddy current sensor 50 described on the surface of the semiconductor wafer W changes as the polishing table 100 rotates, as indicated by scanning lines $SL_1$, $SL_2$, $SL_3$, . . . in FIG. 26. Even in this case, since the eddy current sensor 50 is located so as to pass through the center $C_w$ of the semiconductor wafer W as described above, the locus of the eddy current sensor 50 passes through the center $C_w$ of the semiconductor wafer W in every rotation.

Figure 27:
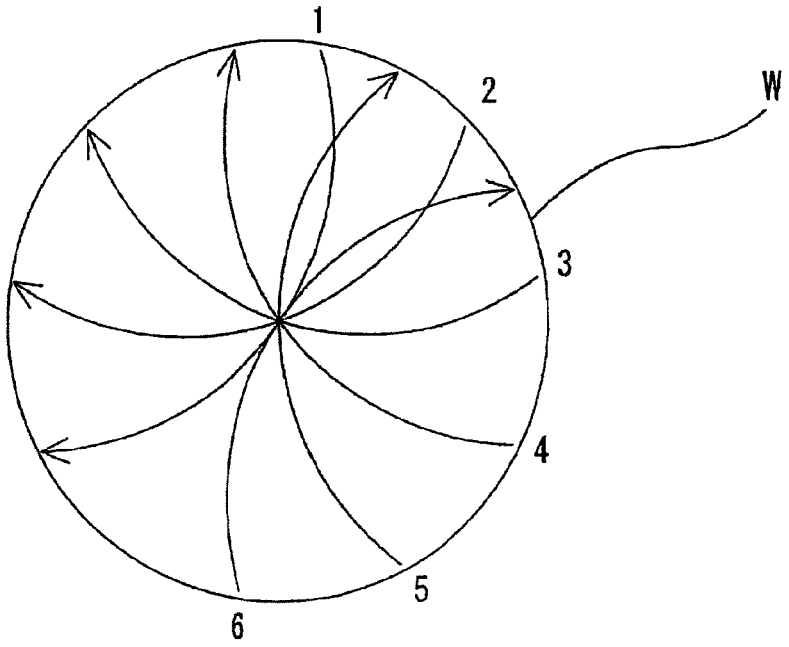
FIG. 27 is a schematic view showing loci of the eddy current sensor sweeping across the semiconductor wafer.

FIG. 27 is a view showing the loci of the eddy current sensor 50 described on the semiconductor wafer within the moving average time (5 seconds in this example) in the case where the rotational speed of the polishing table 100 is 70 $min^{-1}$ and the rotational speed of the top ring 1 is 77 $min^{-1}$. As shown in FIG. 27, under these conditions, the locus of the eddy current sensor 50 rotates by 36 degrees each time the polishing table 100 makes one revolution. Therefore, the locus of the eddy current sensor 50 rotates by half of the circumference of the semiconductor wafer W every time the eddy current sensor 50 scans five times. In view of a curvature of the sensor locus, six-time sweep motions of the eddy current sensor 50 across the semiconductor wafer W within the moving average time allow the eddy current sensor 50 to scan the entire surface of the semiconductor wafer W substantially evenly.

While the rotational speed of the top ring 1 is higher than the rotational speed of the polishing table 100 in the above-described example, the rotational speed of the top ring 1 may be lower than the rotational speed of the polishing table 100 (for example, the rotational speed of the polishing table 100 may be set to 70 $min^{-1}$ and the rotational speed of the top ring 1 may be set to 63 $min^{-1}$). In this case, the sensor locus rotates in the opposite direction, but the loci of the eddy current sensor 50 described on the surface of the semiconductor wafer W within the predetermined period of time are distributed over the entire circumference of the surface of the semiconductor wafer W as well as the above example.

Further, while the ratio of the rotational speeds of the top ring 1 and the polishing table 100 is close to 1 in the above-described example, the ratio of the rotational speeds may be close to 0.5, 1.5, or 2 (i.e., a multiple of 0.5). In this case also, the same results can be obtained. For example, when the ratio of the rotational speeds of the top ring 1 and the polishing table 100 is set to 0.5, the sensor locus rotates by 180 degrees each time the polishing table 100 makes one revolution. When viewed from the semiconductor wafer W, the eddy current sensor 50 moves along the same locus in the opposite direction each time the polishing table 100 makes one revolution.

The ratio of the rotational speeds of the top ring 1 and the polishing table 100 may be slightly shifted from 0.5 (for example, the rotational speed of the top ring 1 may be set to 36 $min^{-1}$ and the rotational speed of the polishing table 100 may be set to 70 $min^{-1}$), so that the sensor locus rotates by $180+\alpha$ degrees each time the polishing table 100 makes one revolution. In this case, the sensor locus is shifted by an apparent angle of $\alpha$ degree(s). Therefore, it is possible to establish the value of $\alpha$ (i.e., the ratio of the rotational speeds of the top ring 1 and the polishing table 100) such that the sensor locus rotates about 0.5 time, or about N time(s), or about 0.5+N times (in other words, a multiple of 0.5, i.e., 0.5×N time(s) (N is a natural number)) on the surface of the semiconductor wafer W within the moving average time.

This method of distributing the loci of the eddy current sensor 50 on the surface of the semiconductor wafer W substantially evenly over the entire circumference of the semiconductor wafer W within the moving average time can allow wide selection of the ratio of the rotational speeds, in consideration of the adjustment of the moving average time. Therefore, this method can be applied to a polishing process which requires great variation of the ratio of the rotational speeds of the top ring 1 and the polishing table 100 in accordance with polishing conditions such as characteristics of a polishing liquid (slurry).

Figure 28:
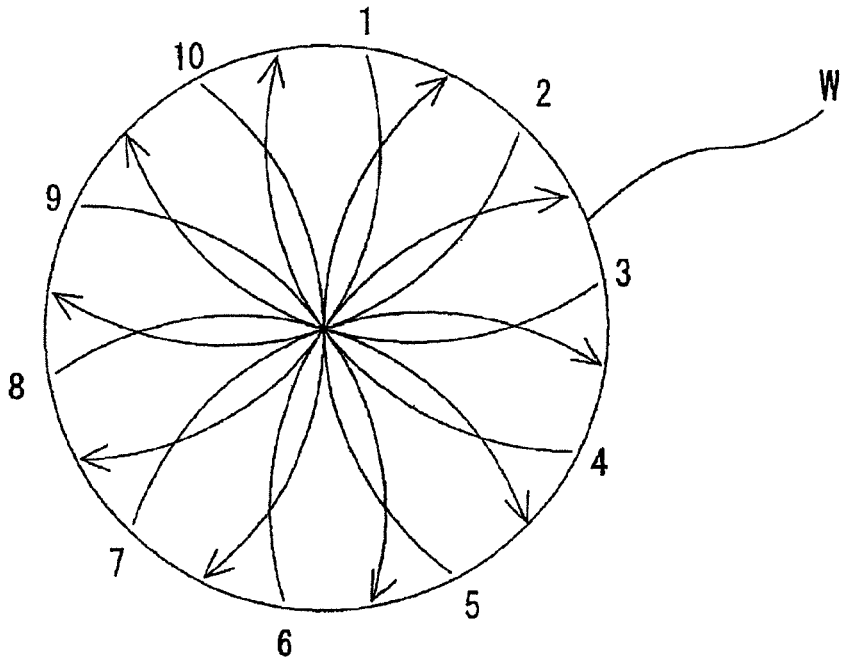
FIG. 28 is a schematic view showing loci of the eddy current sensor sweeping across the semiconductor wafer.

Generally, the locus of the eddy current sensor 50 described on the semiconductor wafer W is curved as shown in FIG. 27, except in a case where the rotational speed of the top ring 1 is just half the rotational speed of the polishing table 100. Therefore, even when the loci of the eddy current sensor 50 on the surface of the semiconductor wafer W are distributed over the entire circumference of the semiconductor wafer W within a predetermined time (e.g., the moving average time), these sensor loci are not evenly distributed in the circumferential direction of the semiconductor wafer W in a strict sense. To exactly distribute the sensor loci evenly in the circumferential direction of the semiconductor wafer W, it is necessary that the sensor locus rotates just N time (s) (N is a natural number) on the semiconductor wafer W in every predetermined period of time. During this period of time, the eddy current sensor 50 scans the surface of the semiconductor wafer W in directions or orientations that are distributed evenly in the circumferential direction of the semiconductor wafer W over the entire circumference thereof. To realize this, the rotational speeds of the polishing table 100 and the top ring 1 are determined such that, while the polishing table 100 makes a predetermined number (natural number) of revolutions, the top ring 1 makes just a predetermined number (natural number) of revolutions that is different from the predetermined number of revolutions of the polishing table 100. In this case also, since the sensor loci are curved as described above, it cannot be said that these loci are distributed at equal intervals in the circumferential direction. However, supposing that every two sensor loci make one pair, the sensor loci can be regarded as being distributed evenly in the circumferential direction at an arbitrary radial position. FIG. 28 shows this example. Specifically, FIG. 28 is a view showing the sensor loci on the semiconductor wafer W while the polishing table 100 makes ten revolutions under the same conditions as those in FIG. 27. As can be understood from the above description, the eddy current sensor 50 can obtain data that more evenly reflect various structures of the entire surface of the semiconductor wafer W, compared with the above example.

Figure 29:
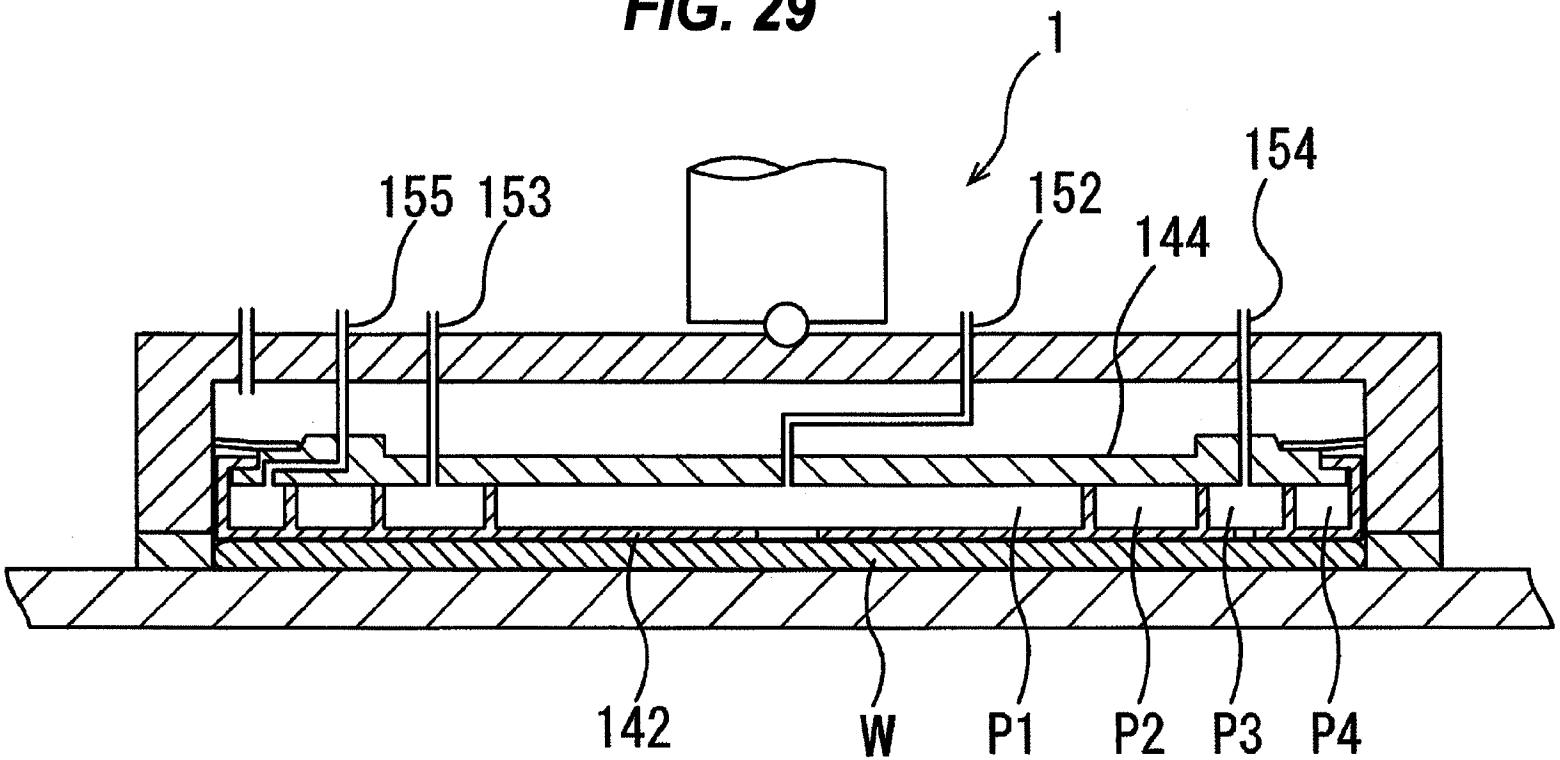
FIG. 29 is a schematic cross-sectional view showing a top ring having a plurality of pressure chambers which is suitably used in the polishing apparatus according to the present invention.

FIG. 29 is a schematic cross-sectional view showing a top ring having a plurality of pressure chambers which is suitably used in the polishing apparatus according to the present invention.

The top ring 1 has a circular elastic pad 142 which is brought into contact with the semiconductor wafer W, and a chucking plate 144 for holding the elastic pad 142. An upper circumferential end portion of the elastic pad 142 is held by the chucking plate 144, and four pressure chambers (air bags) P1, P2, P3 and P4 are provided between the elastic pad 142 and the chucking plate 144. The pressure chambers P1, P2, P3 and P4 are supplied with a pressurized fluid such as pressurized air through respective fluid passages 152, 153, 154 and 155 or are vacuumed through the respective fluid passages 152, 153, 154 and 155. The central pressure chamber P1 is circular, and the other pressure chambers P2, P3 and P4 are annular. These pressure chambers P1, P2, P3 and P4 are arranged in a concentric fashion.

Internal pressures of the pressure chambers P1, P2, P3 and P4 are independently variable by pressure regulating units (not shown). Thus, pressing forces for pressing a semiconductor wafer W against the polishing pad can be independently adjusted at four areas of the semiconductor wafer W, i.e. a central area, an inner intermediate area, an outer intermediate area, and an outer circumferential edge area of the semiconductor wafer W. In this embodiment, the pressure chambers P1, P2, P3 and P4 constitute pressing mechanisms for pressing the four areas of the semiconductor wafer W independently. A thickness of the metal film (or conductive film) mf of the semiconductor wafer W is measured by the eddy current sensor 50 (see FIG. 1) provided in the polishing table 100 during polishing, and a thickness distribution of the film in a radial direction of the semiconductor wafer W is acquired by the controller 56 (see FIG. 18). The controller 56 controls internal pressures of the pressure chamber P1, P2, P3 and P4 in accordance with the thickness distribution of the film. For example, in the case where the metal film (or conductive film) mf on the semiconductor wafer W is thicker at the central portion of the metal film (or conductive film) mf than at the outer circumferential edge portion of the metal film (or conductive film) mf, the pressure of the pressurized chamber P1 is made higher than the pressure of the pressure chamber P4 to allow polishing pressure of the central portion of the metal film (or conductive film) to be higher than polishing pressure of the outer circumferential edge portion of the metal film (or conductive film), thereby achieving a desired polishing profile.

Although certain preferred embodiments of the present invention have been shown and described in detail, it should be understood that various changes and modifications may be made therein without departing from the scope of the appended claims. Any shapes, structures, and materials, which are not described directly in the specification and drawings, may be within the scope of the technical concept of the present invention, as long as they have the same effects of the present invention.

What is claimed is:

1. An eddy current sensor comprising:

a sensor coil to be disposed near a metal film or a conductive film formed on a substrate;

a signal source configured to supply an AC signal to said sensor coil to produce an eddy current in the metal film or the conductive film; and a detection circuit operable to detect the eddy current produced in the metal film or the conductive film on the basis of an output of said sensor coil;

wherein said sensor coil comprises an oscillation coil connected to said signal source, a detection coil operable to detect the eddy current produced in the metal film or the conductive film, and a balancing coil connected in series to said detection coil; and said detection coil comprises a coil formed by a wire or a conductive material wound as a single row and plural layers, a row being defined as a direction perpendicular to the substrate and a layer being defined as a direction parallel to the substrate.

2. An eddy current sensor according to claim 1, wherein said oscillation coil comprises a coil formed by a wire or a conductive material wound as a single row and plural layers, or a coil formed by a wire wound as plural rows and a single layer or wound as plural rows and plural layers.

3. An eddy current sensor according to claim 1, wherein said balancing coil comprises a coil formed by a wire or a conductive material wound as a single row and plural layers.

4. An eddy current sensor according to claim 1, wherein at least one of said detection coil, said oscillation coil and said balancing coil comprises coils formed by a wire or a conductive material wound as a single row and plural layers and connected in series.

5. An eddy current sensor according to claim 1, wherein said oscillation coil is curved so as to be closer to the substrate toward a radially outward edge of said oscillation coil.

6. An eddy current sensor according to claim 1, wherein said detection coil and said oscillation coil have different coil outer diameters.

7. An eddy current sensor according to claim 1, wherein said detection coil, said oscillation coil and said balancing coil are arranged in this order from a substrate side.

8. An eddy current sensor according to claim 1, wherein said detection coil, said oscillation coil and said balancing coil are concentrically arranged.

9. An eddy current sensor according to claim 1, wherein said sensor coil is housed in a tubular member made of a material having a high-magnetic permeability.

10. A polishing method for polishing a film on a substrate as an object to be polished by pressing the substrate against a polishing surface on a rotating polishing table, said polishing method comprising:

scanning a surface, being polished, of the substrate by an end point detecting sensor provided in the polishing table while the polishing table is rotated, during polishing of the substrate;

monitoring an output of the end point detecting sensor obtained by scanning the surface, being polished, of the substrate;

detecting a polishing end point from a change in the output of the end point detecting sensor; and monitoring an output of the end point detecting sensor or a different sensor after detecting the polishing end point and monitoring the remaining film for detecting a film left on a part of the substrate, wherein an eddy current sensor is used for the endpoint detecting sensor or the different sensor, a coil in the eddy current sensor for detecting an eddy current produced in the film on the substrate comprises a coil formed by a wire or a conductive material wound as a single row and plural layers, a row being defined as a direction perpendicular to the substrate and a layer being defined as a direction parallel to the substrate, and said monitoring of the remaining film is performed by the different sensor having a higher sensitivity than the end point detecting sensor, and the different sensor comprises the coil formed by the wire or the conductive material wound as the single row and the plural layers.

11. A polishing method for polishing a film on a substrate as an object to be polished by pressing the substrate against a polishing surface on a rotating polishing table, said polishing method comprising:

scanning a surface, being polished, of the substrate by an end point detecting sensor provided in the polishing table while the polishing table is rotated, during polishing of the substrate;

monitoring an output of the end point detecting sensor obtained by scanning the surface, being polished, of the substrate;

detecting a polishing end point from a change in the output of the end point detecting sensor; and monitoring an output of the end point detecting sensor or a different sensor after detecting the polishing end point and monitoring the remaining film for detecting a film left on a part of the substrate, wherein an eddy current sensor is used for the endpoint detecting sensor or the different sensor, a coil in the eddy current sensor for detecting an eddy current produced in the film on the substrate comprises a coil formed by a wire or a conductive material wound as a single row and plural layers, a row being defined as a direction perpendicular to the substrate and a layer being defined as a direction parallel to the substrate, and said monitoring of the remaining film is performed by switching a sensitivity of the end point detecting sensor, and said switching of the sensitivity of the end point detecting sensor is performed by switching a number of turns of the coil.

12. A polishing method according to claim 10, wherein said monitoring of the remaining film is performed by the different sensor having higher a sensitivity than the end point detecting sensor;

the endpoint detecting sensor and the different sensor comprise an eddy current sensor having an oscillation coil operable to produce an eddy current in the film on the substrate, a detection coil operable to detect the eddy current produced in the film on the substrate, and a balancing coil connected in series to the detection coil; and each of the oscillation coil, the detection coil and the balancing coil in the different sensor comprises a coil formed by a wire or a conductive material wound as a single row and plural layers.

13. A polishing apparatus, having a polishing table with a polishing surface and a to ring for holding a substrate as an object to be polished, for polishing a film on the substrate by pressing the substrate against said polishing surface on the rotating polishing table, said polishing apparatus comprising:

an end point detecting sensor provided in said polishing table for scanning a surface, being polished, of the substrate while said polishing table is rotated;

a controller for monitoring an output of said end point detecting sensor obtained by scanning the surface, being polished, of the substrate and detecting a polishing end point from a change in the output of said end point detecting sensor, monitoring the output of said end point detecting sensor or an output of a different sensor after detecting the polishing end point, and monitoring the remaining film for detecting a film left on a part of the substrate, wherein said endpoint detecting sensor or said different sensor comprises an eddy current sensor, a coil in said eddy current sensor for detecting an eddy current produced in the film on the substrate comprises a coil formed by a wire or a conductive material wound as a single row and plural layers, a row being defined as a direction perpendicular to the substrate and a layer being defined as a direction parallel to the substrate, and the monitoring of the remaining film is performed by said different sensor comprising said eddy current sensor having a higher sensitivity than said end point detecting sensor, and said different sensor comprises said coil formed by said wire or said conductive material wound as the single row and the plural layers.

14. A polishing apparatus, having a polishing table with a polishing surface and a to ring for holding a substrate as an object to be polished, for polishing a film on the substrate by pressing the substrate against said polishing surface on the rotating polishing table, said polishing apparatus comprising:

an end point detecting sensor provided in said polishing table for scanning a surface, being polished, of the substrate while said polishing table is rotated;

a controller for monitoring an output of said end point detecting sensor obtained by scanning the surface, being polished, of the substrate and detecting a polishing end point from a change in the output of said end point detecting sensor, monitoring the output of said end point detecting sensor or an output of a different sensor after detecting the polishing end point, and monitoring the remaining film for detecting a film left on a part of the substrate, wherein said endpoint detecting sensor or said different sensor comprises an eddy current sensor, a coil in said eddy current sensor for detecting an eddy current produced in the film on the substrate comprises a coil formed by a wire or a conductive material wound as a single row and plural layers, a row being defined as a direction perpendicular to the substrate and a layer being defined as a direction parallel to the substrate, and the monitoring of the remaining film is performed by switching a sensitivity of said end point detecting sensor, and the switching of the sensitivity of said end point detecting sensor is performed by switching a number of turns of said coil.

15. A polishing apparatus according to claim 13, wherein said end point detecting sensor or said different sensor comprises said eddy current sensor having an oscillation coil operable to produce the eddy current in the film on the substrate, a detection coil operable to detect the eddy current produced in the film on the substrate, and a balancing coil connected in series to said detection coil.

16. A polishing apparatus according to claim 15, wherein said oscillation coil comprises a coil formed by a wire wound as a single row and plural layers, or a coil formed by a wire or a conductive material wound as plural rows and a single layer or wound as plural rows and plural layers.

17. A polishing apparatus according to claim 15, wherein said balancing coil comprises a coil formed by a wire or a conductive material wound as a single row and plural layers.

18. A polishing apparatus according to claim 15, wherein at least one of said detection coil, said oscillation coil and said balancing coil comprises coils formed by a wire or a conductive material wound as a single row and plural layers and connected in series.

19. A polishing apparatus according to claim 15, wherein said oscillation coil is curved so as to be closer to the substrate toward a radially outward edge of said oscillation coil.

20. An eddy current sensor according to claim 15, wherein said detection coil and said oscillation coil have different coil outer diameters.

21. A polishing apparatus according to claim 15, wherein said detection coil, said oscillation coil and said balancing coil are arranged in this order from a substrate side.

22. A polishing apparatus according to claim 15, wherein said detection coil, said oscillation coil and said balancing coil are concentrically arranged.

23. A polishing apparatus according to claim 15, wherein said sensor coil is housed in a tubular member made of a material having a high-magnetic permeability.

24. A polishing apparatus according to claim 14, wherein said end point detecting sensor or said different sensor comprises said eddy current sensor having an oscillation coil operable to produce the eddy current in the film on the substrate, a detection coil operable to detect the eddy current produced in the film on the substrate, and a balancing coil connected in series to said detection coil.

25. A polishing apparatus according to claim 24, wherein said oscillation coil comprises a coil formed by a wire wound as a single row and plural layers, or a coil formed by a wire or a conductive material wound as plural rows and a single layer or wound as plural rows and plural layers.

26. A polishing apparatus according to claim 24, wherein said balancing coil comprises a coil formed by a wire or a conductive material wound as a single row and plural layers.

27. A polishing apparatus according to claim 24, wherein at least one of said detection coil, said oscillation coil and said balancing coil comprises coils formed by a wire or a conductive material wound as a single row and plural layers and connected in series.

28. A polishing apparatus according to claim 24, wherein said oscillation coil is curved so as to be closer to the substrate toward a radially outward edge of said oscillation coil.

29. An eddy current sensor according to claim 24, wherein said detection coil and said oscillation coil have different coil outer diameters.

30. A polishing apparatus according to claim 24, wherein said detection coil, said oscillation coil and said balancing coil are arranged in this order from a substrate side.

31. A polishing apparatus according to claim 24, wherein said detection coil, said oscillation coil and said balancing coil are concentrically arranged.

32. A polishing apparatus according to claim 24, wherein said sensor coil is housed in a tubular member made of a material having a high-magnetic permeability.

* * * * *

UNITED STATES PATENT AND TRADEMARK OFFICE

CERTIFICATE OF CORRECTION

PATENT NO. : 8,657,644 B2
APPLICATION NO. : 13/313407
DATED : February 25, 2014
INVENTOR(S) : Tada et al.

It is certified that error appears in the above-identified patent and that said Letters Patent is hereby corrected as shown below:

In the Claims

Column 33, line 54 claim 13, “to” should read --top--.

Column 34, line 19 claim 14, “to” should read --top--.

Signed and Sealed this
Third Day of June, 2014

Michelle K. Lee

Michelle K. Lee
*Deputy Director of the United States Patent and Trademark Office*